US010920519B2

(12) United States Patent
Bobeck

(10) Patent No.: US 10,920,519 B2
(45) Date of Patent: Feb. 16, 2021

(54) BLOW OUT PREVENTER BONNET HANDLING APPARATUS AND METHOD

(71) Applicant: Mark Bobeck, Houston, TX (US)

(72) Inventor: Mark Bobeck, Houston, TX (US)

( * ) Notice: Subject to any disclaimer, the term of this patent is extended or adjusted under 35 U.S.C. 154(b) by 0 days.

(21) Appl. No.: 16/290,091

(22) Filed: Mar. 1, 2019

(65) Prior Publication Data

US 2020/0208488 A1 Jul. 2, 2020

Related U.S. Application Data

(60) Provisional application No. 62/785,775, filed on Dec. 28, 2018, provisional application No. 62/812,007, filed on Feb. 28, 2019.

(51) Int. Cl.
*E21B 33/06* (2006.01)

(52) U.S. Cl.
CPC ..... *E21B 33/061* (2013.01)

(58) Field of Classification Search
CPC ..... E21B 33/061; E21B 33/062; E21B 33/063
USPC ..... 137/15.01; 166/377; 251/1.3, 1.1
See application file for complete search history.

(56) References Cited

U.S. PATENT DOCUMENTS 3,411,576 A 11/1968 Taylor, Jr.
4,003,430 A 1/1977 Carnahan
4,206,929 A 6/1980 Bruce
4,325,534 A * 4/1982 Roark ..... E21B 33/062 251/1.3
5,507,465 A 4/1996 Borle
5,875,841 A 3/1999 Wright et al.
6,024,172 A 2/2000 Lee
6,510,897 B2 * 1/2003 Hemphill ..... E21B 33/063 166/373
7,096,960 B2 8/2006 Hemphill et al.
7,357,187 B2 4/2008 Gass
7,665,530 B2 * 2/2010 Wells ..... E21B 19/16 166/377
7,802,626 B2 9/2010 Hemphill et al.
8,230,930 B2 * 7/2012 Hemphill ..... E21B 33/063 166/373
9,022,126 B2 * 5/2015 Melancon ..... E21B 33/08 166/360
9,027,217 B2 * 5/2015 Cranford ..... E21B 19/00 166/85.4
9,488,031 B2 11/2016 Leuchtenberg et al.
(Continued)

OTHER PUBLICATIONS

The International Search Report and the Written Opinion of the International Searching Authority, International Application No. PCT/US2019/020255, dated Jul. 9, 2019.

*Primary Examiner* — Jessica Cahill
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

A blow out preventer bonnet removal method is provided for removing a bonnet from the body of a blow out preventer. The method includes attaching a rail system to the body that extends laterally away from the body. A carriage apparatus is mounted on the rail system. A saddle is connected to the bonnet. The bonnet is then detached from the body. The bonnet is then moved on the rail system from a first position next to the body to a second position spaced away from the body. The carriage apparatus transports the bonnet upon the rail system when moving from the first to the second position.

17 Claims, 28 Drawing Sheets

(56) References Cited

U.S. PATENT DOCUMENTS

| | | | | |
|---|---|---|---|---|
| 9,506,313 | B2 | 11/2016 | Jahnke | |
| 9,689,233 | B2 | 6/2017 | Nguyen et al. | |
| 9,732,577 | B2 | 8/2017 | Holland, Jr. et al. | |
| 9,790,761 | B2 | 10/2017 | Prabhakaran et al. | |
| 9,879,497 | B2 | 1/2018 | Pendleton et al. | |
| 10,352,106 | B1 * | 7/2019 | Vogt | E21B 19/14 |
| 2003/0006043 | A1 | 1/2003 | Luca et al. | |
| 2003/0085040 | A1 | 5/2003 | Hemphill et al. | |
| 2011/0048736 | A1 * | 3/2011 | Childers | E21B 19/00 166/379 |
| 2015/0226026 | A1 * | 8/2015 | Kent | E21B 33/06 166/379 |
| 2017/0067309 | A1 | 3/2017 | Holland, Jr. et al. | |
| 2017/0107778 | A1 | 4/2017 | Krishnasamy et al. | |
| 2017/0107779 | A1 | 4/2017 | Akhare et al. | |
| 2017/0138152 | A1 * | 5/2017 | Cowie | E21B 29/08 |

* cited by examiner

BLOW OUT PREVENTER BONNET HANDLING APPARATUS AND METHOD

CROSS-REFERENCE TO RELATED APPLICATIONS

This application claims benefit of U.S. Provisional Patent Application Ser. No. 62/785,775, filed 28 Dec. 2018; and U.S. Provisional Patent Application Ser. No. 62/812,007, filed 28 Feb. 2019, each of which is incorporated herein by reference.

Priority of U.S. Provisional Patent Application Ser. No. 62/785,775, filed 28 Dec. 2018; and U.S. Provisional Patent Application Ser. No. 62/812,007, filed 28 Feb. 2019, each of which is incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to blowout preventers (or BOPs) that are used in the oil and gas well exploration industry (e.g., drilling and production). More particularly, the present invention relates to an improved blowout preventer bonnet handling apparatus/tool that is able to cradle and transport a BOP bonnet between a starting or home position and a laterally spaced, removed position that enables a lifting (e.g., overhead crane) and/or servicing of the bonnet. In one embodiment, actuators (e.g., hydraulic cylinders) extend and retract to transport a saddle assembly that supports the weight of the bonnet when removed from the BOP body.

2. General Background of the Invention

Blowout preventers are safety devices used in the oil and gas exploration industry. They are well known in the art. Patents/publications discuss blowout preventers and the bonnet portions (e.g., see US Publication 2017/0107778A1, which is hereby incorporated herein by reference). The bonnet is a housing that holds a ram or other component. The bonnets must be removed for servicing/maintenance after a period of use. Bonnets are heavy and must be carefully handled to avoid injury to a worker/personnel, and/or damages to a bonnet, and/or bonnet components.

The following possibly relevant US Patents are each hereby incorporated herein by reference:

| Patent No. | Title | Issue Date MM-DD-YYYY |
|---|---|---|
| 4,003,430 | Apparatus for the Replacement of Seals in a Well Ram Type Blow Out Preventer | Jan. 18, 1977 |
| 6,510,897 | Rotational Mounts for Blowout Preventer Bonnets | Jan. 28, 2003 |
| 7,357,187 | BOP Conversion Apparatus | Apr. 15, 2008 |
| 7,802,626 | Mounts for Blowout Preventer Bonnets and Methods of Use | Sep. 28, 2010 |
| 9,027,217 | Blowout Preventer Head Removal Tools and Methods | May 12, 2015 |
| 9,506,313 | Contoured Ram Bore on Type U Blowout Preventer | Nov. 29, 2016 |
| 9,689,233 | Platform to Service a Blowout Preventer | Jun. 27, 2017 |
| 9,732,577 | Blowout Preventer with Hinged Bonnet | Aug. 15, 2017 |
| 9,790,761 | Boltless Ram Blowout Preventer Bonnet | Oct. 17, 2017 |
| 9,879,497 | Blowout Preventer | Jan. 30, 2018 |
| 2003/0006043 | Internal Blow-Out Preventer Change-Out Tool | Jan. 9, 2003 |
| 2003/0085040 | Mounts for Blowout Preventer Bonnets | May 8 ,2003 |
| 2017/0067309 | Blowout Preventer with Hinged Bonnet | Mar. 9, 2017 |
| 2017/0107778 | Boltless Locking of BOP Bonnet | Apr. 20, 2017 |
| 2017/0107779 | BOP Booster Piston Assembly and Method | Apr. 20, 2017 |

BRIEF SUMMARY OF THE INVENTION

The present invention provides an improved method and apparatus for handling bonnets so that they can be lifted and/or serviced or repaired.

The present invention provides a blow out preventer bonnet removal method and apparatus for removing a bonnet from the body of a blow out preventer. The method includes an initial step of attaching a bonnet transporter or rail system to the BOP body. The transporter or rail system preferably extends laterally away from the body.

A carriage (or carrier) and ratchet sleeve apparatus is preferably attached to the transporter or rail system. The carriage supports a saddle or saddle assembly that can be connected to the bonnet to be transported.

The bonnet can be moved from a first position next to the body to a second position spaced away from the body wherein the carriage apparatus and ratchet sleeve transport the bonnet upon the rail system.

In one embodiment, transporter can be a rail system including spaced apart beams or rails and further comprising positioning the bonnet in between the rails.

In one embodiment, a saddle assembly that moves with the carriage apparatus is preferably clamped to the bonnet.

In one embodiment, the carriage apparatus with saddle is preferably ratcheted relative to the rail system with a ratchet sleeve or skidder ratchet. The ratchet sleeve or skidder ratchet moves the carriage and saddle in short increments along the rail system. Each increment can equate to the extension distance of a hydraulic cylinder (or cylinders) that extend and retract during ratcheting transport of the carriages and bonnet along the rail system.

In one embodiment, the method includes using hydraulic fluid during ratcheting transport (e.g., hydraulic cylinder(s)) to move each carriage and saddle assembly.

In one embodiment, the rail system is preferably supported by one or more support legs.

In one embodiment, lifting the saddle and bonnet with an overhead lifting device such as a crane can be accomplished after the saddle and bonnet are moved to an outer end portion of the rail system and spaced away from the BOP body.

In one embodiment, the saddle preferably has one or more lifting fittings or pad-eyes and the lifting device can be attached to the one or more pad-eyes with suitable rigging (e.g., slings, shackles, hooks or wire rope) for moving the bonnet to a location for servicing or repair.

In one embodiment, the present invention provides a blow out preventer bonnet removal method for removing a bonnet from the body of a blow out preventer wherein initially a pair of beams are preferably attached to the BOP body. The beams each preferably extend laterally away from the body.

In one embodiment, the carriage apparatus includes a pair of carriages or carriers. One carriage is preferably mounted on each rail or beam, each carriage supporting the saddle.

The saddle is preferably connected to the bonnet that is to be removed for service or repair.

The bonnet is preferably disconnected (e.g., unbolted) from the BOP body wherein the bonnet can then be moved from a first position next to the body to a second position that is spaced away from the body wherein the carriages transport the bonnet upon the beams to outer end portions of the beams.

In one embodiment, the beams have spaced apart slots that interface with cams or dogs on the ratchet sleeve mechanism.

In one embodiment, the saddle can be clamped to the bonnet.

In one embodiment, the carriages can be ratcheted relative to beams using a ratchet sleeve mechanism.

In one embodiment, the ratcheting preferably includes using hydraulic fluid to move the carriages along the beams.

In one embodiment, the step of lifting the saddle and bonnet with an overhead lifting device preferably enables transport of the bonnet from the rails and/or rail system to a location for service and/or repair and/or to a transport vehicle (e.g., tractor trailer).

In one embodiment, the elevation of the saddle can be changed with one or more lift cylinders or like operators to fine tune alignment of the saddle relative to the bonnet such as before clamping the saddle to the bonnet.

In one embodiment, the rail system or rails can include attaching a plurality of beam mounts to the body of the blow out preventer.

In one embodiment, the beams have outer or free end portions and the method includes supporting the beams with one or more legs at a position in between the body of the blow out preventer and the beam free ends.

The present invention includes a blow out preventer bonnet removal method for removing a bonnet from a body of a blow out preventer, including the steps of:

a) attaching a rail system to the body that extends laterally away from the body;

b) mounting a carriage apparatus to the rail system;

c) connecting a saddle assembly to the bonnet;

d) detaching the bonnet from the body after step "c"; and e) moving the bonnet from a first position next to the body to a second position spaced away from the body wherein the carriage apparatus transports the bonnet upon the rail system.

In one embodiment, the rail system includes spaced apart rails and further comprising positioning the bonnet in between the rails.

In one embodiment, the saddle assembly can be clamped to the bonnet.

In one embodiment, preferably ratcheting the carriage apparatus relative to the rail system.

In one embodiment, the ratcheting includes using hydraulic fluid to move the saddle assembly.

In one embodiment, the rail system can be supported by one or more legs.

In one embodiment, preferably lifting the saddle and bonnet with an overhead lifting device.

In one embodiment, the saddle has one or more pad-eyes and the lifting device preferably attaches to the one or more pad-eyes.

In one embodiment, preferably changing the elevation of the saddle to fine tune alignment of the saddle relative to the bonnet.

The present invention includes a blow out preventer bonnet removal method for removing a bonnet from a body of a blow out preventer. The present invention includes the steps of:

a) attaching a pair of beams to the body that each preferably extend laterally away from the body;

b) mounting carriages on the rail beams, the carriages supporting a saddle;

c) connecting the saddle to the bonnet;

d) detaching the bonnet from the body after step "c"; and e) moving the bonnet from a first position next to the body to a second position that is spaced away from the body wherein the carriages transport the bonnet upon the beams.

In one embodiment, the beams preferably include gearing that interfaces with ratchet mechanisms on the carriages.

In one embodiment, the saddle can be clamped to the bonnet.

In one embodiment, preferably ratcheting the carriages relative to the beams.

In one embodiment, the ratcheting preferably includes using hydraulic fluid to move the carriages along the beams.

In one embodiment, preferably lifting the saddle and bonnet with an overhead lifting device.

In one embodiment, preferably changing the elevation of the saddle to fine tune alignment of the saddle relative to the bonnet.

In one embodiment, preferably attaching a plurality of beam mounts to the body of the blow out preventer.

In one embodiment, each of the pair of beams preferably have a free end portion and further comprising supporting the pair of beams with one or more legs at a position in between the body of the blow out preventer and the free end portions.

In one embodiment, each beam can have a ratchet system that includes one or more ratcheting sleeves mounted on each rail and a hydraulic cylinder that extends and retracts to move the bonnet a distance with each extension of the hydraulic cylinder.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE PREFERRED EMBODIMENT

Blowout preventers are known, commercially available devices that are used to contain an oil well that is flowing at a high rate and at high pressure. Examples can be seen in U.S. Pat. Nos. 3,411,576; 4,206,929; 5,507,465; 5,875,841; 6,024,172; and 9,488,031, which are each hereby incorporated herein by reference. Blowout preventers are commercially available from Schlumberger Oilfield Services, National Oilwell Varco, Weatherford International, Cameron International Corporation and other suppliers/manufacturers. Many blowout preventers have a structural body to which are affixed housings or bonnets that contain known BOP components, such as rams for example. Many blow out preventers have external frames that make removal of the bonnets problematic.

Figure 1:
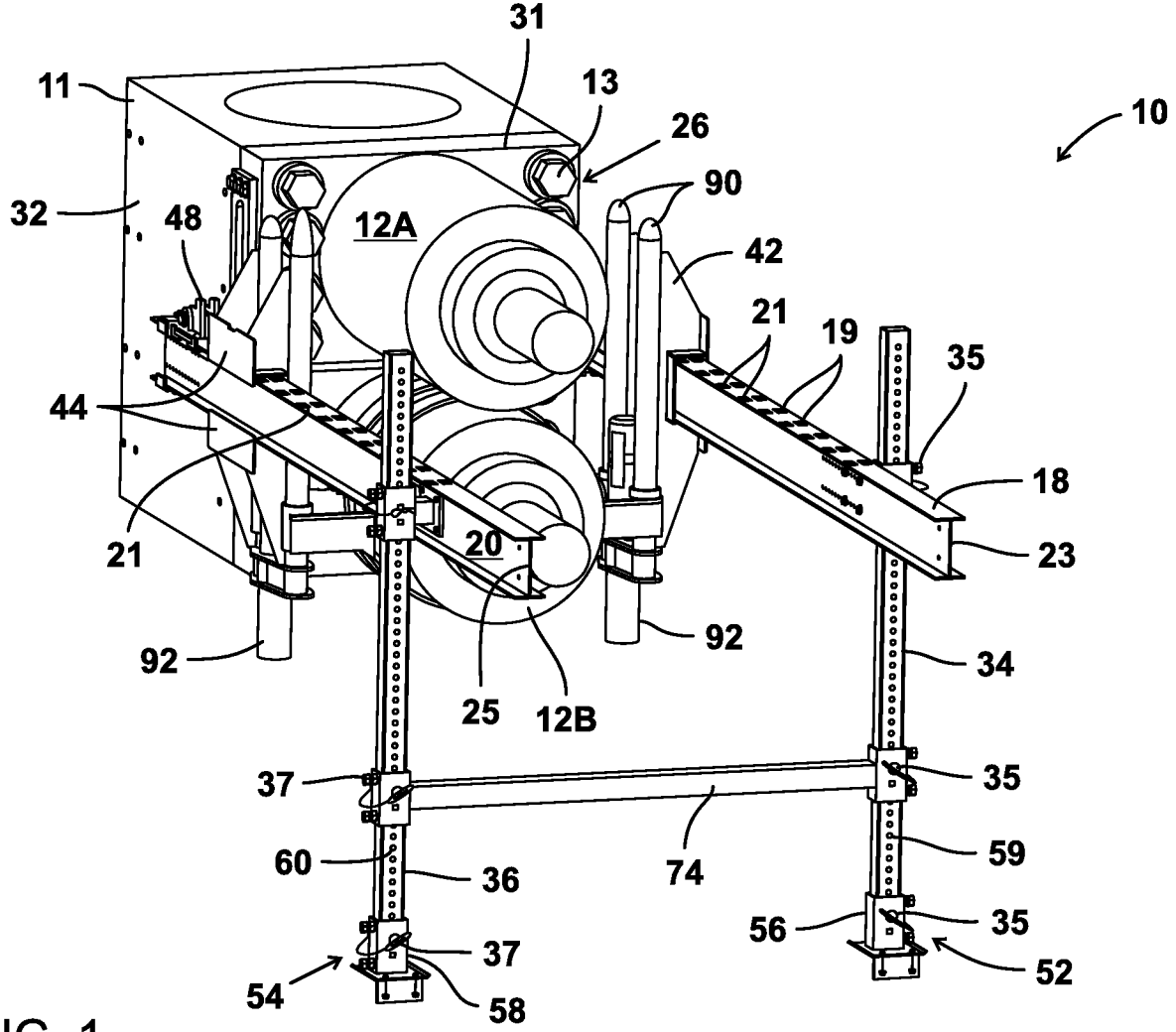
FIG. 1 is a perspective view of a preferred embodiment of the apparatus of the present invention.
Figure 2:
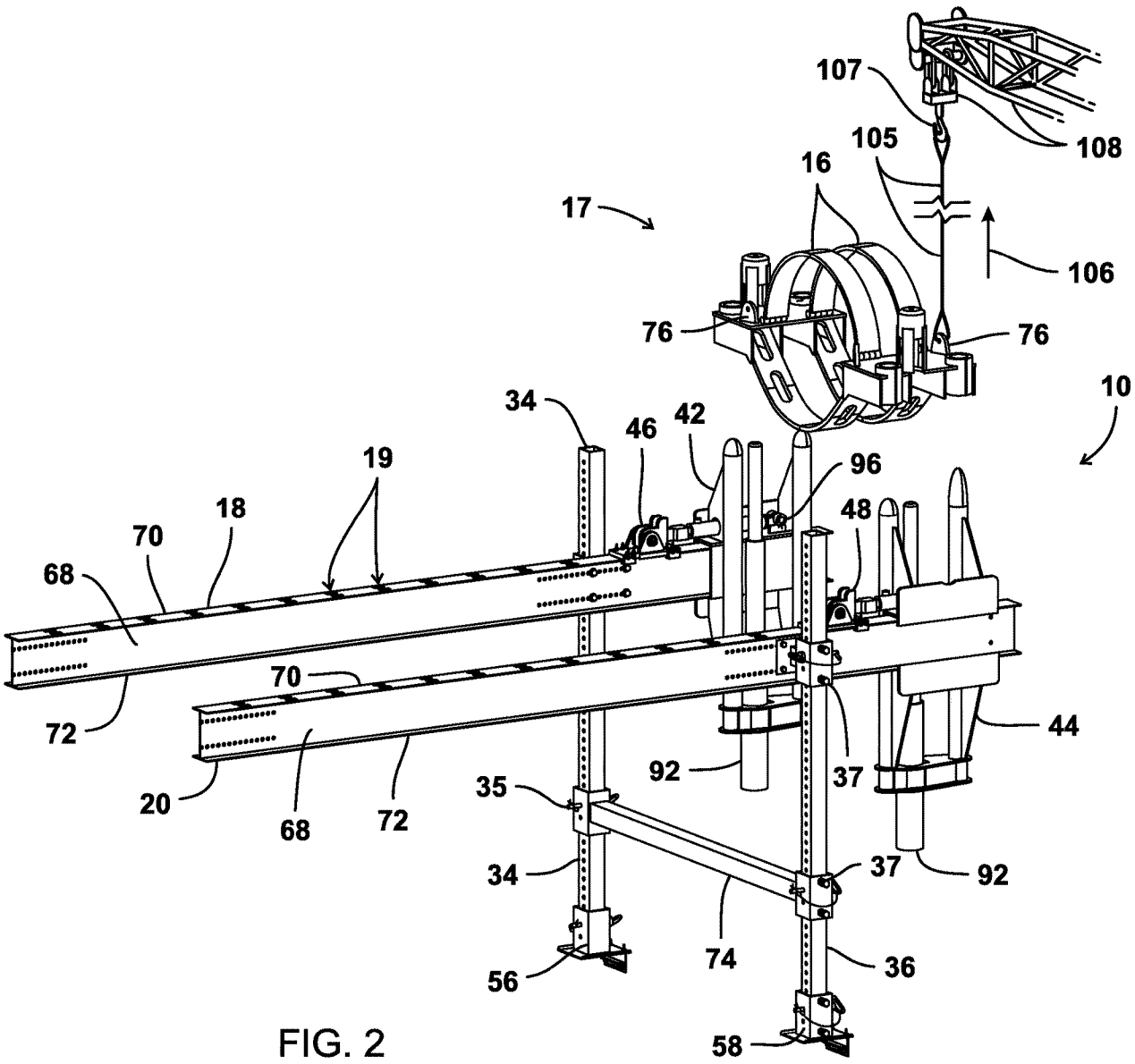
FIG. 2 is a perspective view of a preferred embodiment of the apparatus of the present invention.

In FIGS. 1-4, a blowout preventer body 11 is schematically shown to which is attached bonnet removal/handling tool 10 of the present invention. Each bonnet 12A, 12B can have a bonnet flange 31. One or more bonnets 12 (or 12A, 12B) are preferably attached to housing 11 (e.g., bolted to housing 11). It should be understood that blowout preventer bodies 11 with bonnets 12 are well known. In FIGS. 1-8, there is seen an upper bonnet 12A and a lower bonnet 12B. From time to time, these bonnets 12A, 12B must be removed from body 11 for service or repair. In order to remove a bonnet 12 (e.g., an upper 12A or lower 12B bonnet), it is preferably supported with apparatus 10 and then moved laterally away from body 11. In FIG. 1, upper and lower bonnets 12A, 12B, are shown still attached to body 11. In FIGS. 3, 6, 8 and 10, upper bonnet 12A can be seen supported with a saddle assembly 17 that can include saddle 14 and strap or straps 16. Straps 16 secures upper bonnet 12A to saddle 14. Saddle 14 (see FIGS. 2-11) can be two (2) spaced apart U-shaped or concave members 16 or a single U-shaped or concave member 15. Saddle 14 and straps 16 are wrapped around the body of upper bonnet 12A. Straps 16 can have hinges at 27. One or more turnbuckles 29 on saddle assembly 17 can be used to tighten straps 16. Saddle 14 supports the weight of upper bonnet 12A once upper bonnet 12A has been removed (e.g., unbolted) from BOP body 11. Saddle 14 can be provided with lifting fittings or pad-eyes 76 (see FIGS. 7-8) for transferring upper bonnet 12A to an overhead lifting device (e.g., a crane) via rigging such as lift line(s), cable(s), wire rope(s), sling(s) or the like. The saddle assembly 17, including saddle 14 and straps 16, is movable and can be moved to support lower bonnet 12B during removable of lower bonnet 12B.

Figure 3:
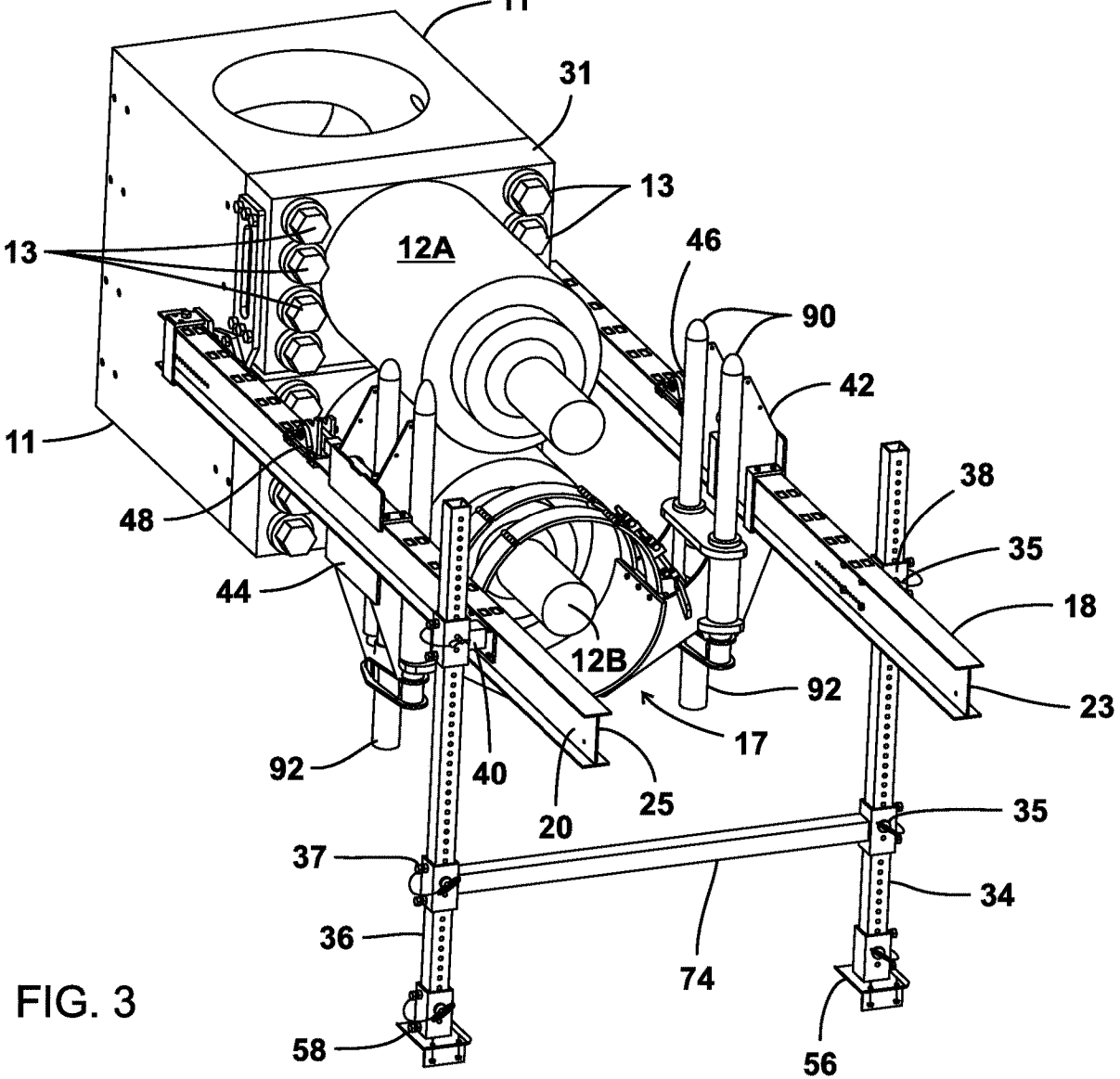
FIG. 3 is a perspective view of a preferred embodiment of the apparatus of the present invention.
Figure 4:
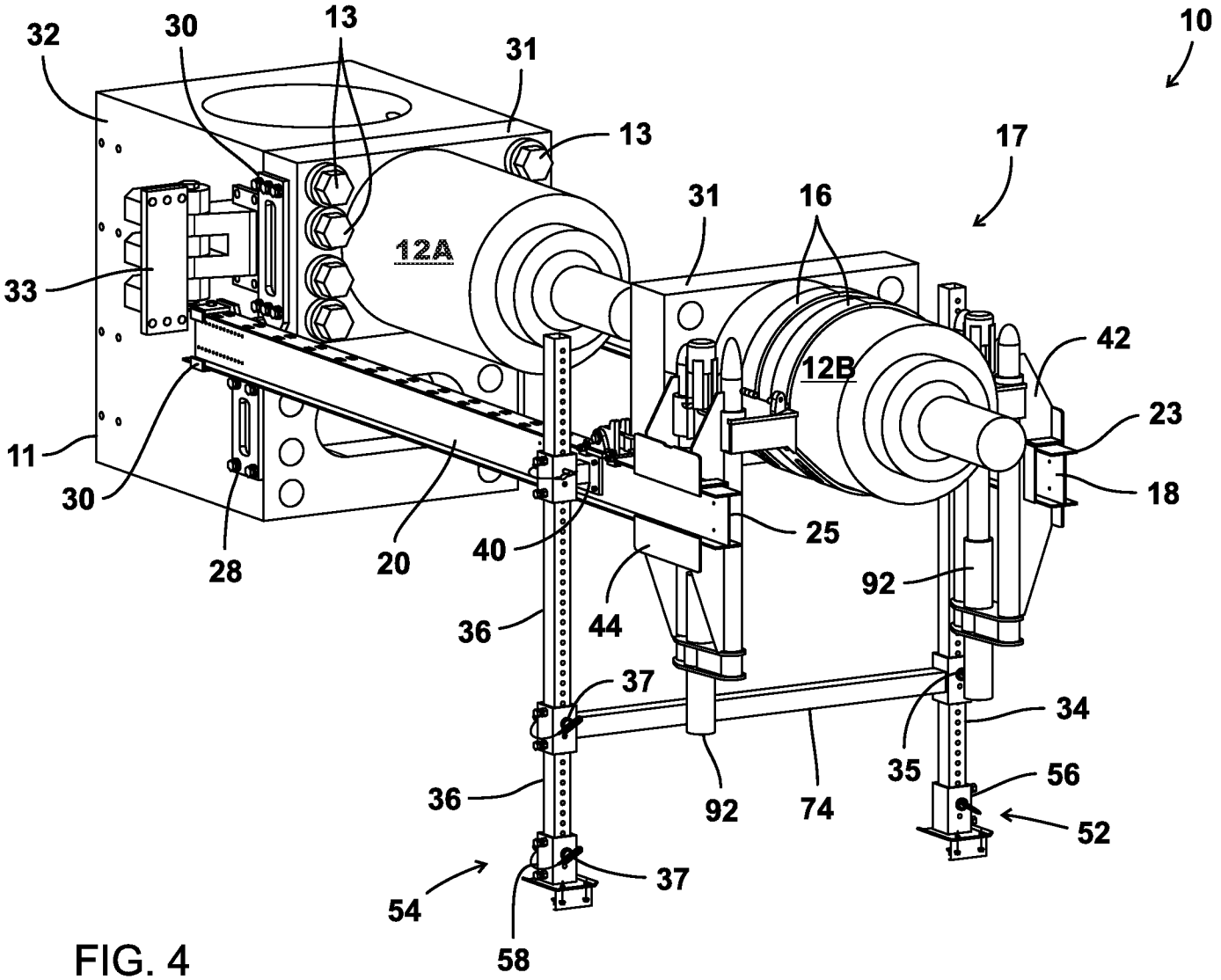
FIG. 4 is a perspective view of a preferred embodiment of the apparatus of the present invention.
Figure 5:
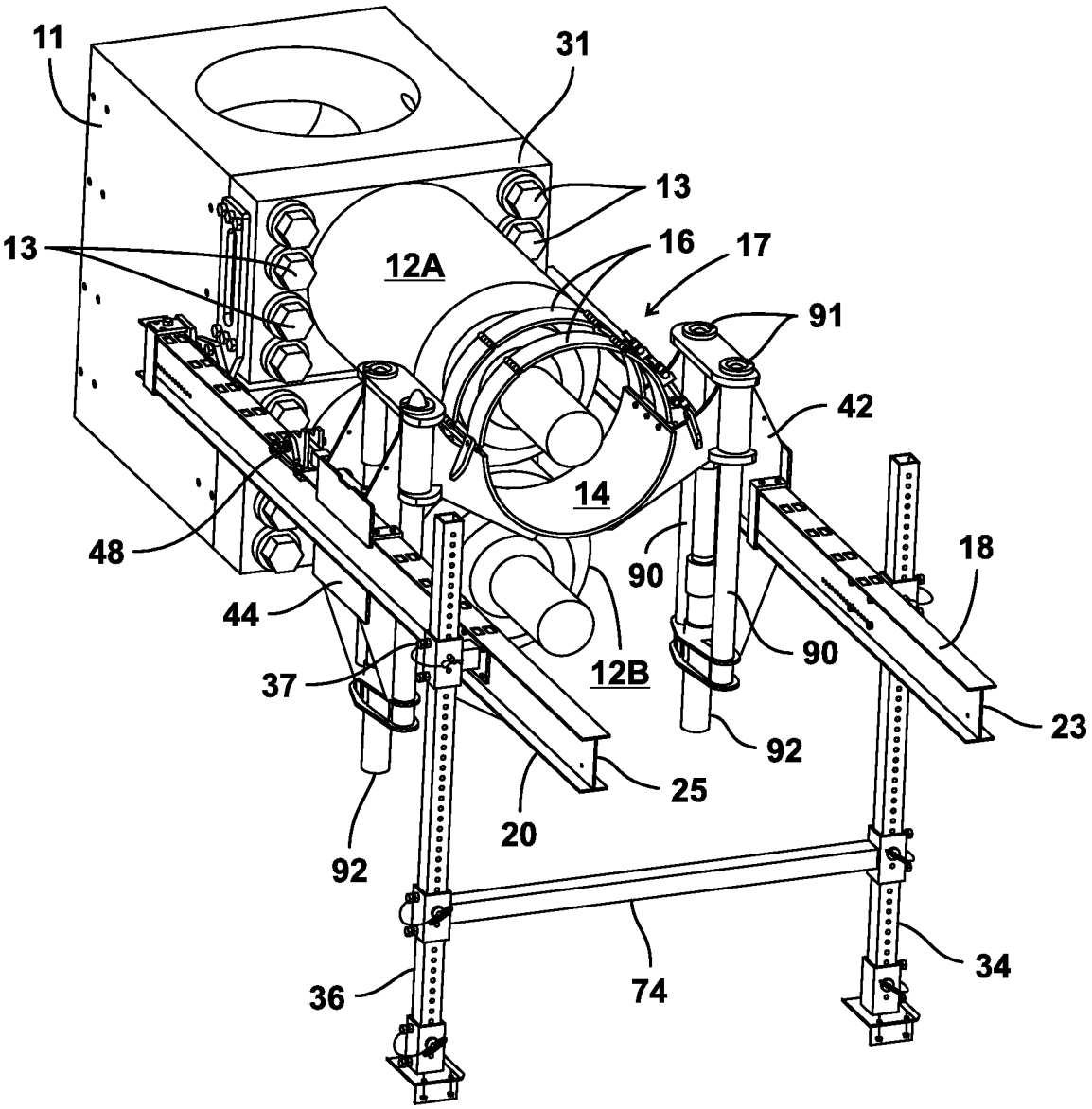
FIG. 5 is a perspective view of a preferred embodiment of the apparatus of the present invention.
Figure 6:
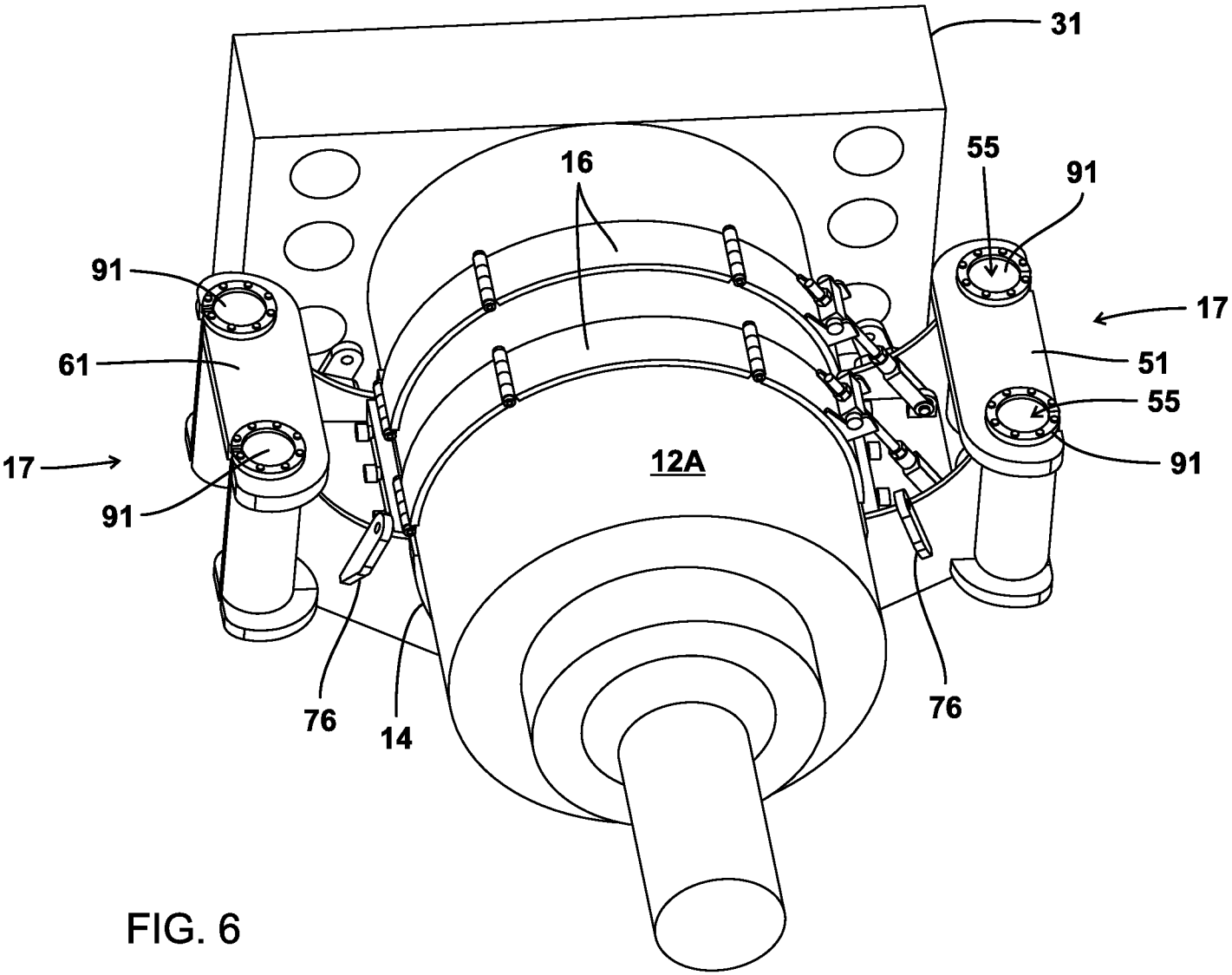
FIG. 6 is a partial elevation view of a preferred embodiment of the apparatus of the present invention.
Figure 7:
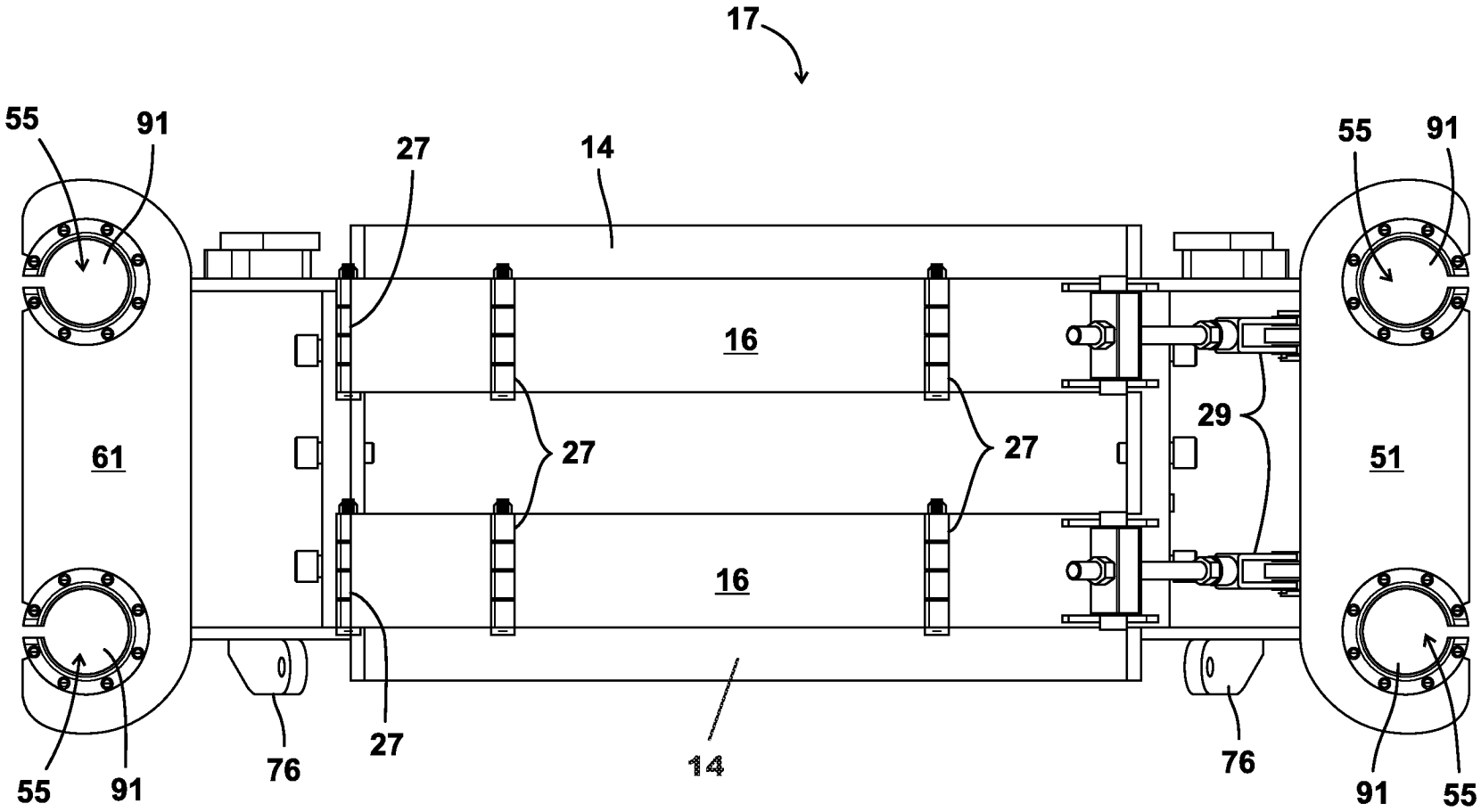
FIG. 7 is a partial plan view of a preferred embodiment of the apparatus of the present invention.
Figure 8:
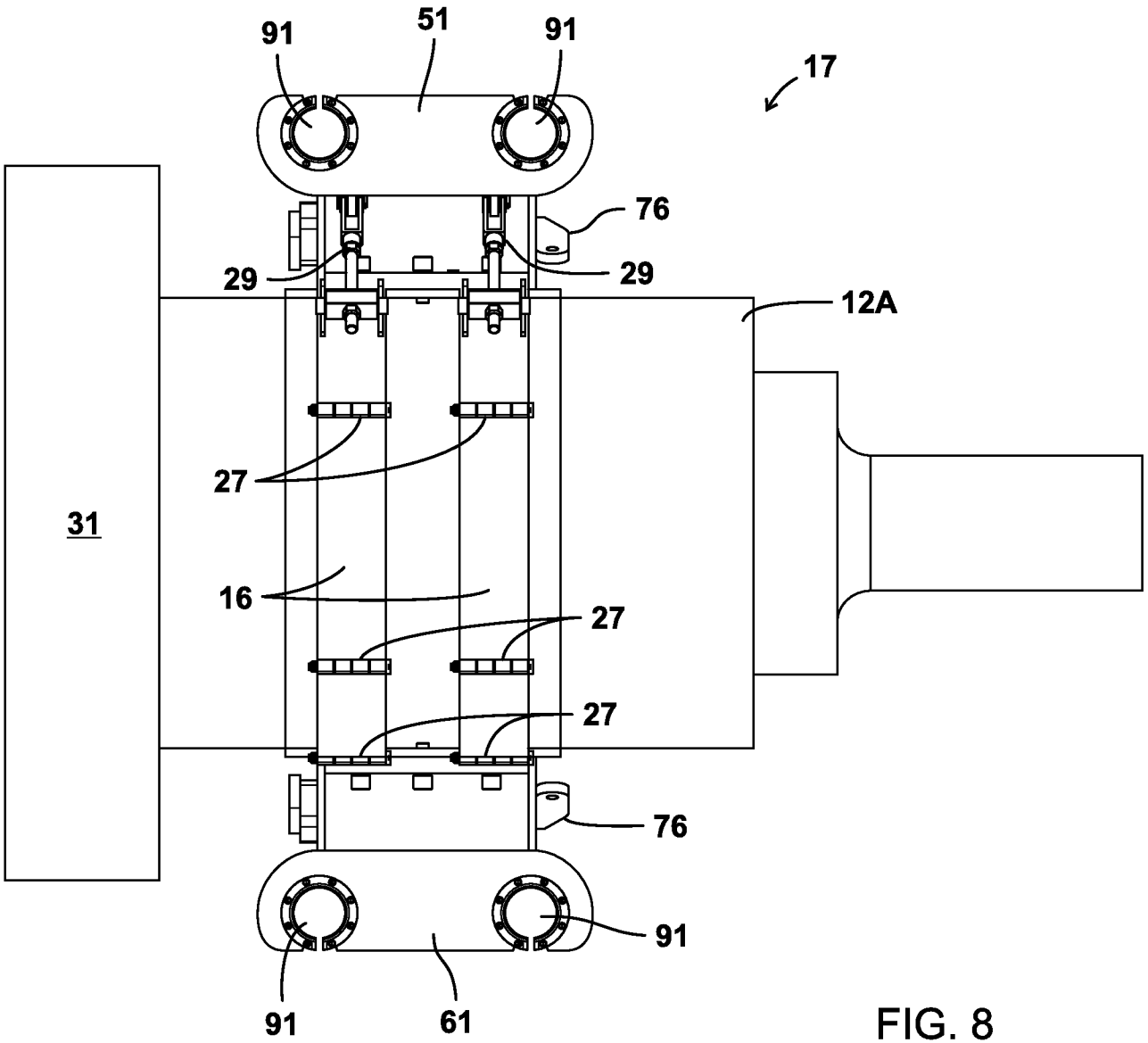
FIG. 8 is a partial plan view of a preferred embodiment of the apparatus of the present invention.
Figure 9:
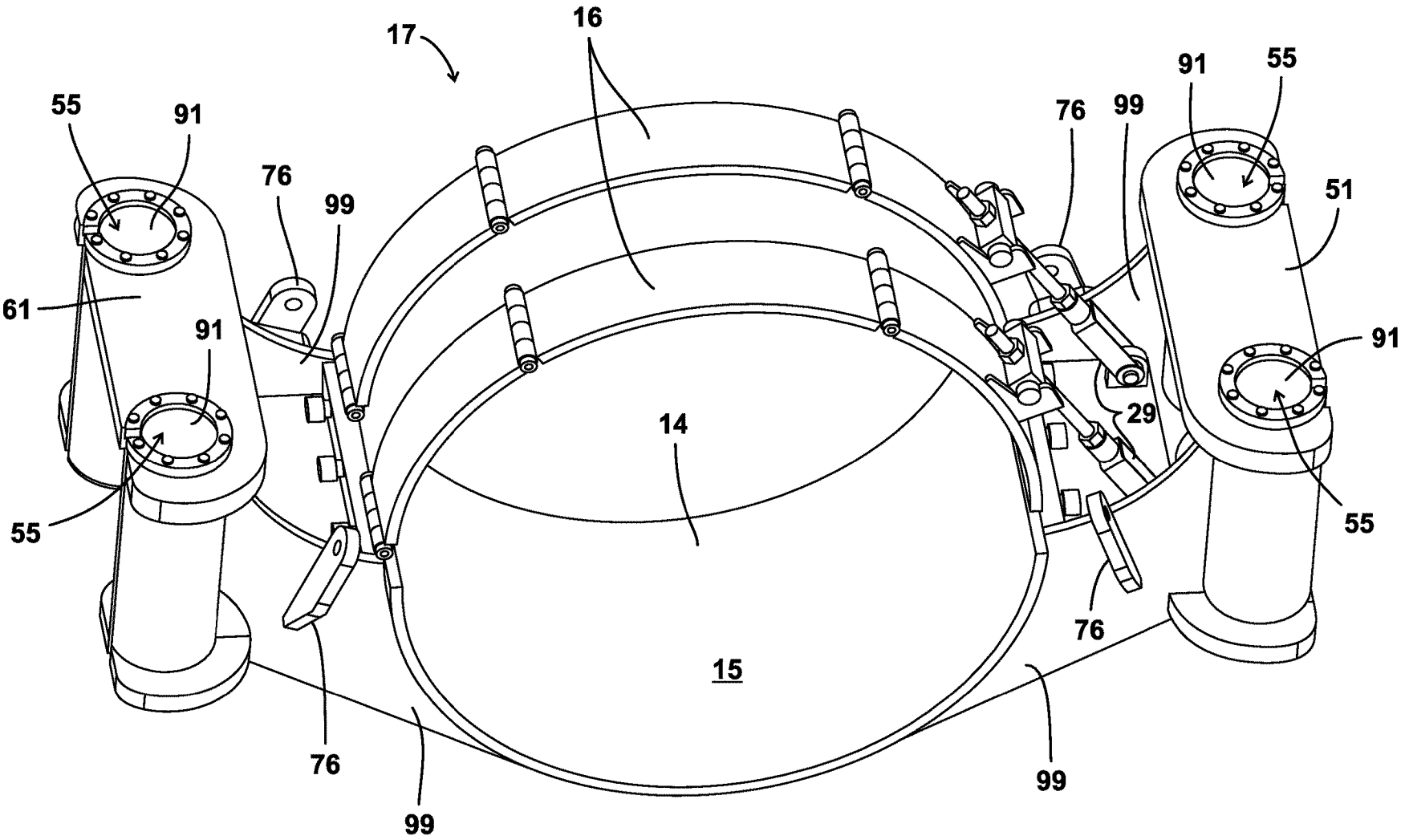
FIG. 9 is a partial perspective view of a preferred embodiment of the apparatus of the present invention.
Figure 10:
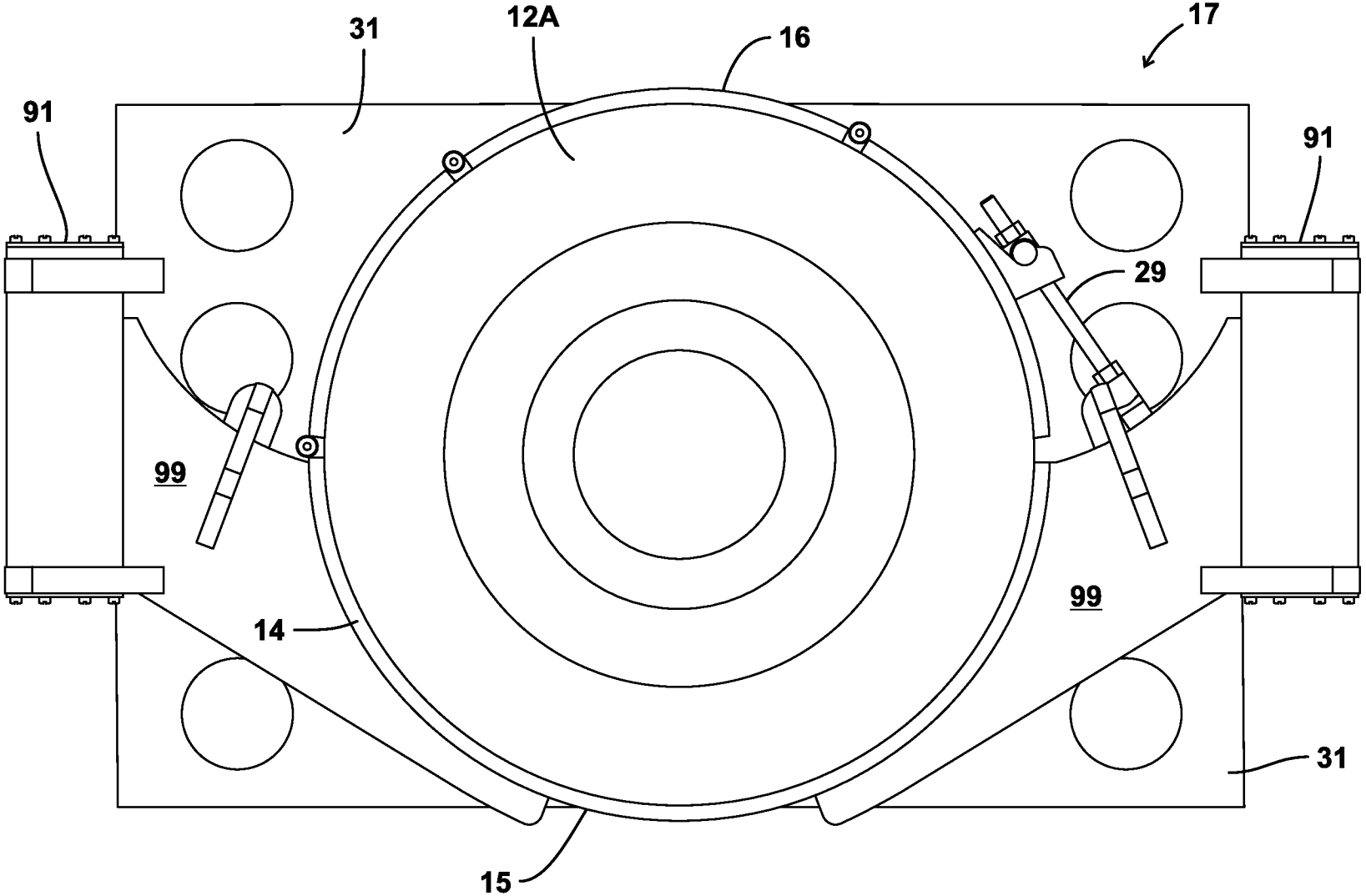
FIG. 10 is a partial end view of a preferred embodiment of the apparatus of the present invention.
Figure 11:
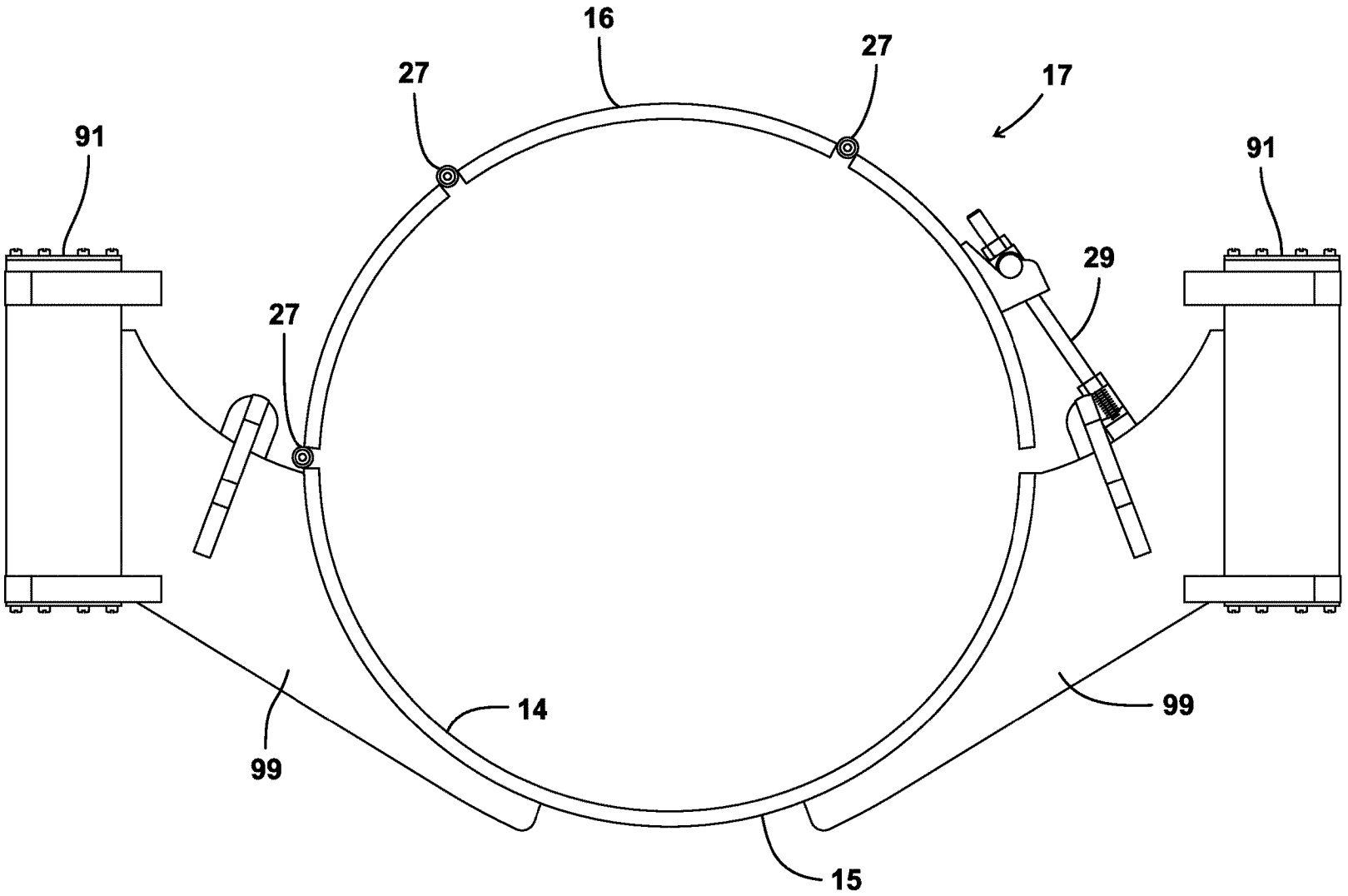
FIG. 11 is a partial end view of a preferred embodiment of the apparatus of the present invention.
Figure 15:
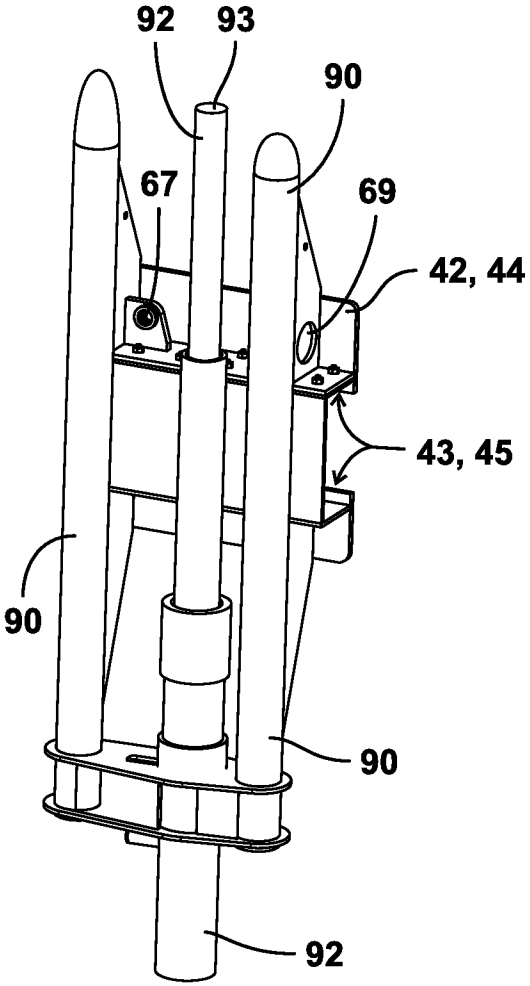
FIG. 15 is a fragmentary view of a preferred embodiment of the apparatus of the present invention.
Figure 14:
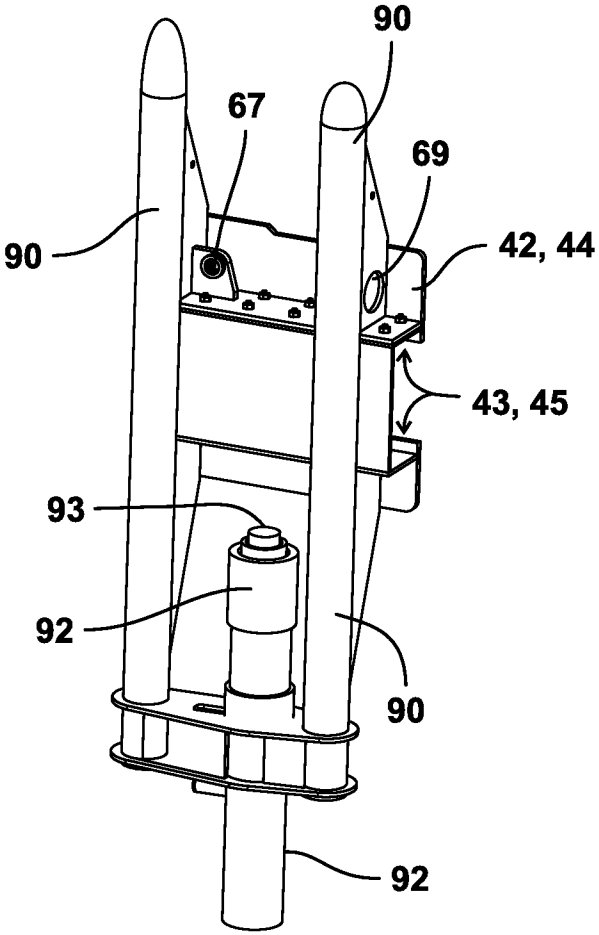
FIG. 14 is a fragmentary perspective view of a preferred embodiment of the apparatus of the present invention.
Figure 13:
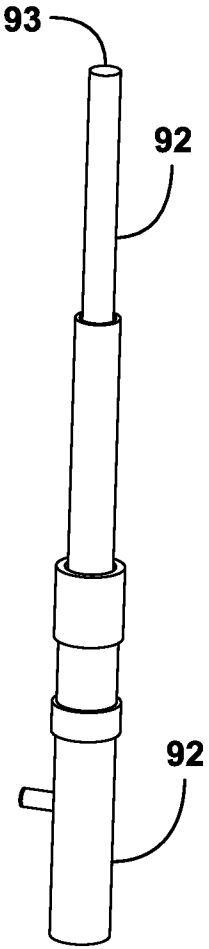
FIG. 13 is a fragmentary perspective view of a preferred embodiment of the apparatus of the present invention.
Figure 12:
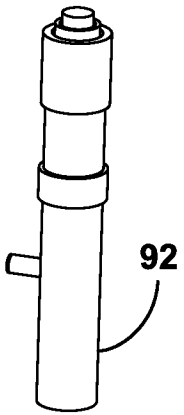
FIG. 12 is a fragmentary perspective view of a preferred embodiment of the apparatus of the present invention.
Figure 16:
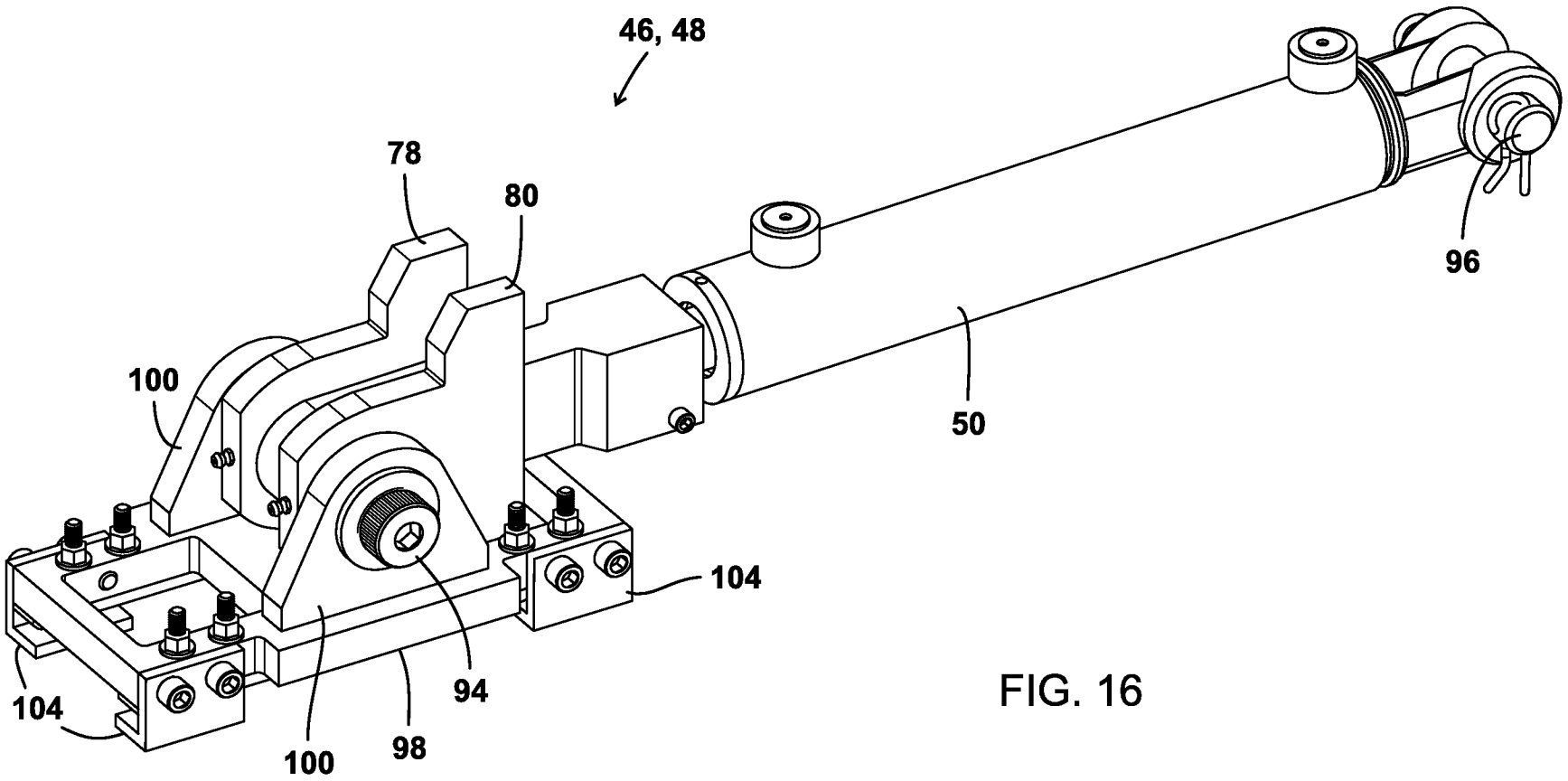
FIG. 16 is a partial perspective view of a preferred embodiment of the apparatus of the present invention showing a ratchet sleeve mechanism with cams or dogs in a pulling position that enables the hydraulic cylinder to pull the carriages toward a BOP body.

Apparatus 10 provides a lateral transport or rail system (railway, skid or laterally extending track or tracks) that can include two spaced apart (first and second) beams, rails or tracks 18, 20. Beams 18, 20 preferably attach to brackets 28, 30 (see FIGS. 37-44) that are preferably affixed (e.g., bolted) to body 11 on opposing sides 26, 32 of body 11. Bracket 30 and bonnet hinge 33 can be used when removing lower bonnet 12B, as seen in FIGS. 3-4. Brackets 28 are preferably used when removing upper bonnet 12A. In FIG. 5, brackets 28 can be attached to body sides 26, 32. Removal of bonnet hinge 33 can be a difficult task. Thus, use of bracket 30 with bonnet hinge 33 allows for removal of lower bonnet 12B without removing bonnet hinge 33 from body 11.

Beams 18, 20 can be flanged beams (e.g., I beams or wide flanged beams) having a web 68 and flanges 70, 72. Each beam or track 18, 20 preferably has a free end. Beam 18 has free end 23. Beam 20 has free end 25.

In FIGS. 3-5 and 33-36, bracket 28 can be mounted (e.g., bolted) on side 26 of body 11. Bracket 30 can be mounted (e.g., bolted) to side 32 of body 11. End brackets 28, 30 can be arranged on either side 26, 32 regardless of operation or complete tear down to remove either bonnet 12, e.g., upper 12A or lower 12B bonnet. Beams 18, 20 function as rails or tracks that enable carriages 42, 44 and ratchet sleeve mechanisms 46, 48 (see FIGS. 16-30) to preferably transport upper bonnet 12A and saddle 14 from a first position next to body 11 (see FIGS. 1 and 5) to a second position spaced away from body 11 (see FIG. 3).

Each carriage 42, 44 is preferably equipped with one or more lift cylinders 92 (which can be for example hydraulic cylinders), preferably enabling saddle 14 to be moved vertically to fine tune its elevation relative to a bonnet 12 (e.g., relative to upper 12A or lower 12B bonnets) and BOP body 11 (see FIGS. 1-5 and 12-15). Each carriage 42, 44 preferably has a pair of cylindrically shaped guides or bearings 90 (see FIGS. 14-15). Saddle assembly 17 can have sleeves or bearings 91 with vertical/longitudinal openings or bores 55 that can be occupied by bearings 90 (e.g., one bearing 90 in each vertical opening 55 of sleeve 91 of saddle assembly 17 (see FIG. 5)). Gussets or plates 99 preferably connect saddle 14 to sleeves or bearings 91. A lift cylinder 92 on each carriage 42, 44 is able to lift or lower saddle 14 relative to carriages 42, 44. As an example, there can be two (2) bearings 90 on each carriage 42, 44 and one lift cylinder 92 on each carriage 42, 44 (see FIGS. 2-15). The lift cylinder 92 preferably enables a fine tuning of the elevation of saddle assembly 17 relative to an upper bonnet 12A or lower bonnet 12B. The lift cylinders 92 can be used to elevate the saddle 14 so that it conforms to the bottom of upper bonnet 12A. The saddle strap 16 is preferably placed over upper bonnet 12A and preferably bolted in place. Lift cylinders 92 can be multi-section telescoping hydraulic cylinders (commercially available). Each hydraulic cylinder 92 has an upper end 93 that engages plate 51 or 61 of saddle assembly 17.

The upper bonnet 12A to blowout preventer bolts 13 are loosened and the saddle lift cylinders 92 can then be adjusted to maintain alignment. The saddle 14 is then moved to the position of FIG. 3, which can be a travel of about 100 inches (254 centimeters).

Legs 34, 36 can be provided to support beams 18, 20 as seen in FIGS. 1-5. In FIGS. 1-5, each leg 34, 36 has a horizontal or lateral section at 38, 40 to offset beams 18, 20 from legs 34, 36. Legs 34, 36 and beams 18, 20 support saddle assembly 17 which can be sized and shaped to cradle or support any selected bonnet 12, e.g., upper 12A and/or lower 12B bonnet, that is to be serviced/repaired.

In the starting or base position of FIGS. 1 and 5, saddle 14 and saddle strap 16 are to be secured to upper bonnet 12A before removal of upper bonnet 12A from body 11. Upper bonnet 12A can then be disconnected (e.g., unbolted) from body 11. In FIG. 1, apparatus 10 is in an initial, home, or starting position for removing bonnet 12B. Upper bonnet 12A is also connected to body 11 prior to removal. A selected bonnet 12A or 12B is attached to saddle 14 and secured to saddle 14 with strap or straps 16. Once secured to saddle 14 and straps 16, selected bonnet 12A or 12B can be disconnected (e.g., unbolted) from body 11 by removing bolts 13.

Saddle assembly 17 including saddle 14 and straps 16 are each mounted to carriages 42, 44 as seen in FIGS. 3-5 and 14-15. Carriages 42, 44 can be mounted onto main beams 18, 20 by sliding carriages 42, 44 onto a free end 23, 25 of each beam 18, 20 wherein each beam 18, 20 occupies a recess 43, 45 on carriage 42, 44 (See FIGS. 2-5 and 14-15). Expandable cylinder/hydraulic cylinder/actuator/travel cylinder 50 attachment or mount 96 connects with a carriage 42, 44 at opening 67 (e.g., pinned connection). Each carriage 42, 44 can have an opening 69 that the cylinder 50 can pass through (see FIGS. 14, 15). Carriages 42, 44 and saddle 14 can be moved along beams 18, 20 by ratchet sleeve mechanisms 46, 48 for the selective removal (or installation) of upper, lower bonnets 12A, 12B. Each carriage 42, 44 can be moved by ratcheting sleeve mechanisms 46, 48 that are ratcheted with an actuator 50 (e.g., hydraulic cylinder). First 46 and second 48 ratchet sleeve mechanisms are each connected to actuator or expandable cylinder 50 (see FIGS. 2-5 and 16-24). FIGS. 16-30 show ratchet sleeve mechanisms 46, 48 in more detail.

Figure 19:
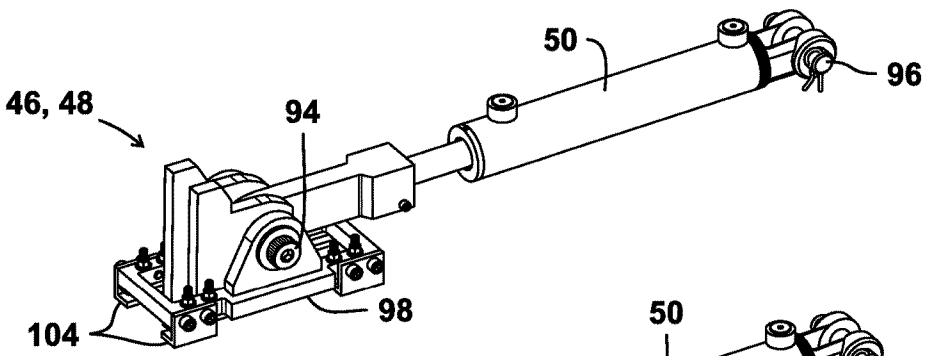
FIG. 19 is a partial perspective view of a preferred embodiment of the apparatus of the present invention showing a ratchet sleeve mechanism with cams or dogs in a pushing position that enables the hydraulic cylinder to push the carriages away from a BOP body.
Figure 18:
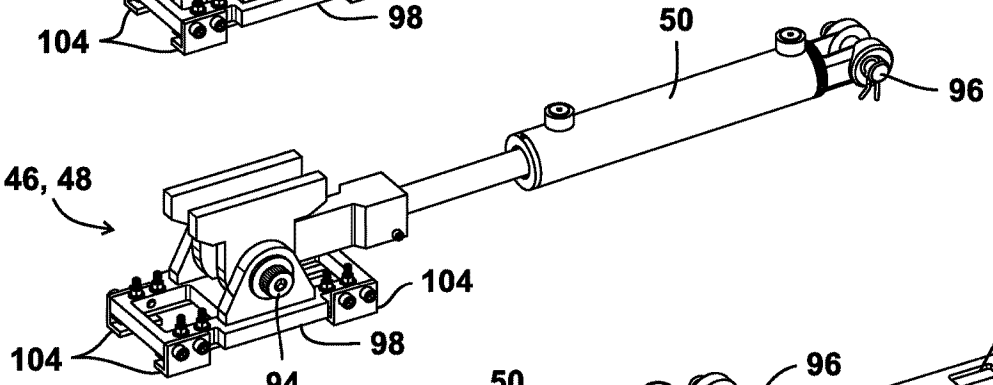
FIG. 18 is a partial perspective view of a preferred embodiment of the apparatus of the present invention showing a ratchet sleeve mechanism with cams or dogs in a transitional position.
Figure 17:
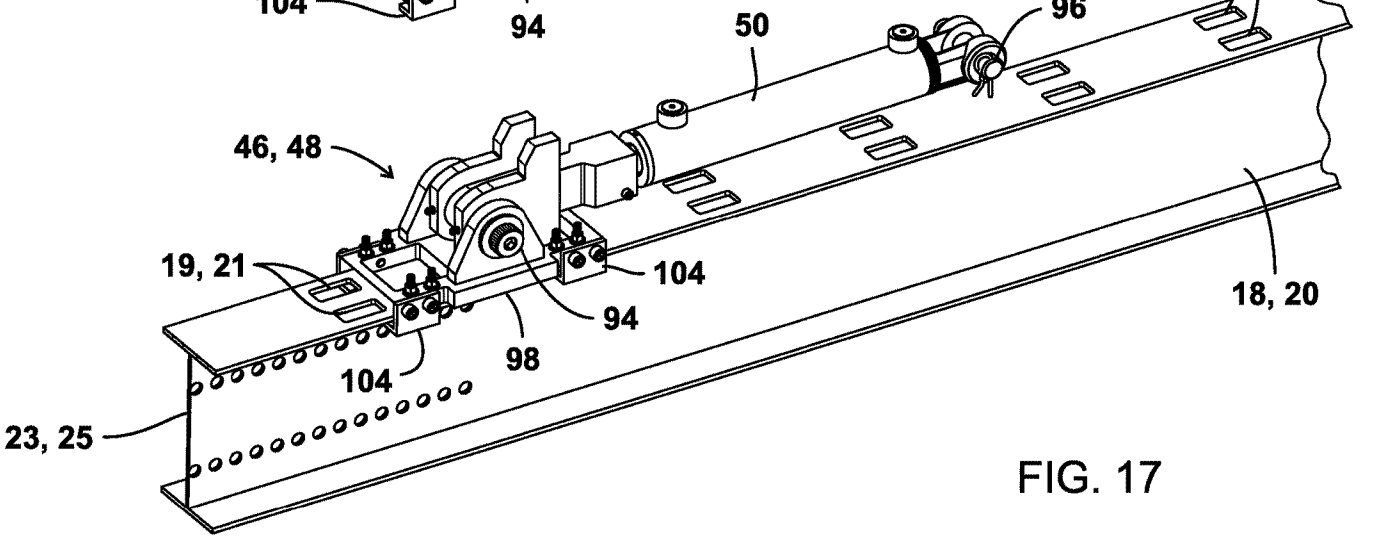
FIG. 17 is a partial perspective view of a preferred embodiment of the apparatus of the present invention showing a ratchet sleeve mechanism with cams or dogs in a pulling position that enables the hydraulic cylinder to pull the carriages toward a BOP body.
Figure 22:
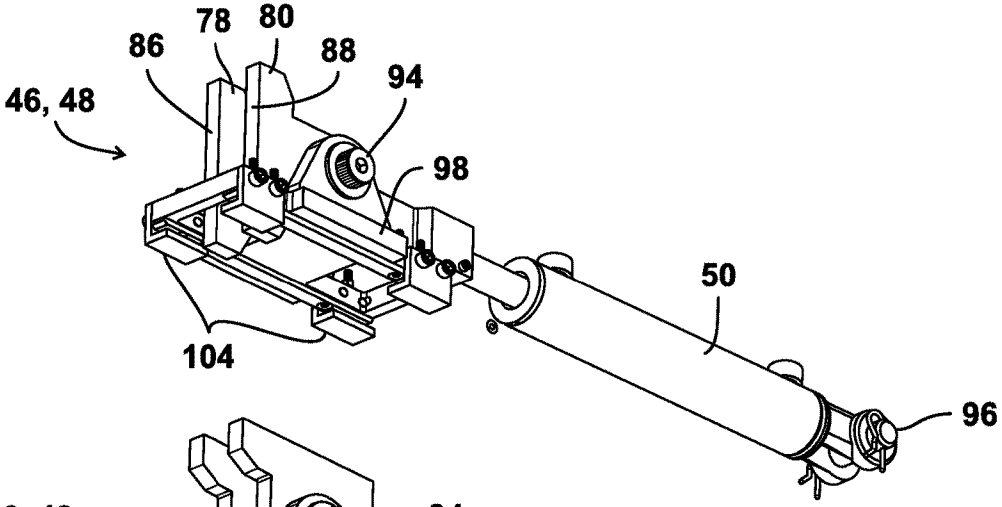
FIG. 22 is a partial perspective view of a preferred embodiment of the apparatus of the present invention showing a ratchet sleeve mechanism with cams or dogs in a pushing position that enables the hydraulic cylinder to push the carriages away from a BOP body.
Figure 21:
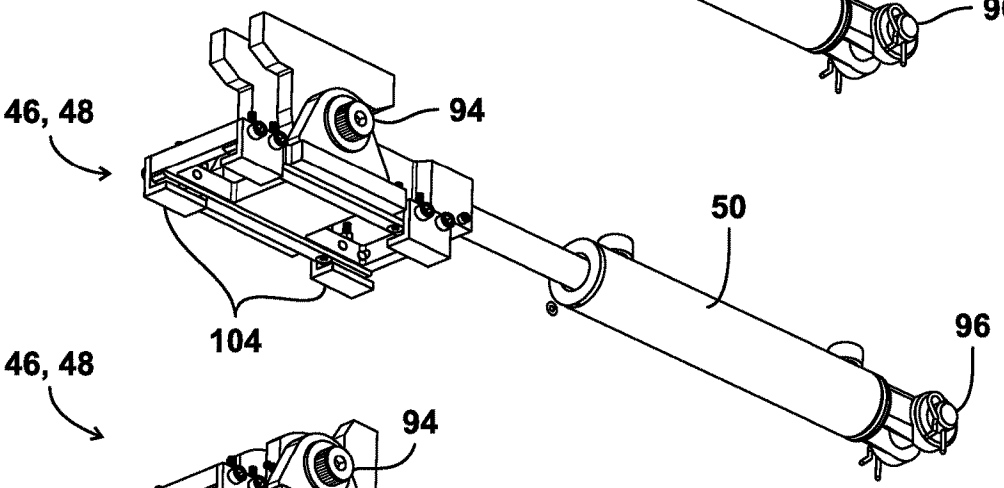
FIG. 21 is a partial perspective view of a preferred embodiment of the apparatus of the present invention showing a ratchet sleeve mechanism with cams or dogs in a transitional position.
Figure 20:
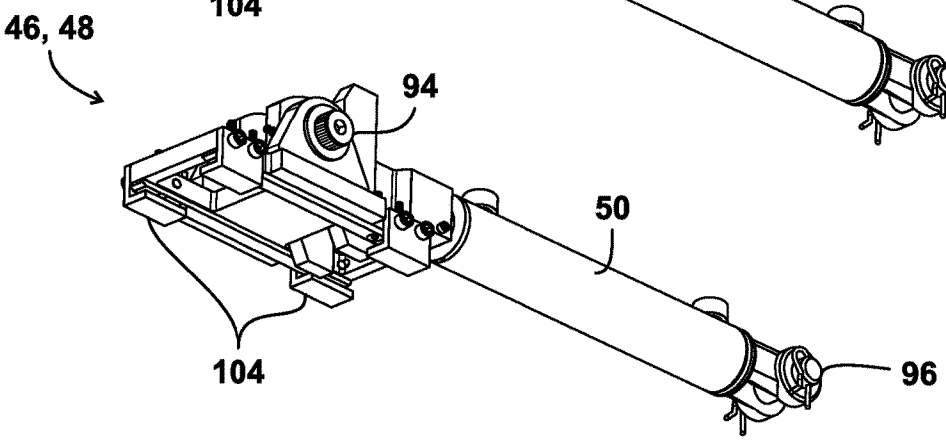
FIG. 20 is a partial perspective view of a preferred embodiment of the apparatus of the present invention showing a ratchet sleeve mechanism with cams or dogs in a pulling position that enables the hydraulic cylinder to pull the carriages toward a BOP body.
Figure 24:
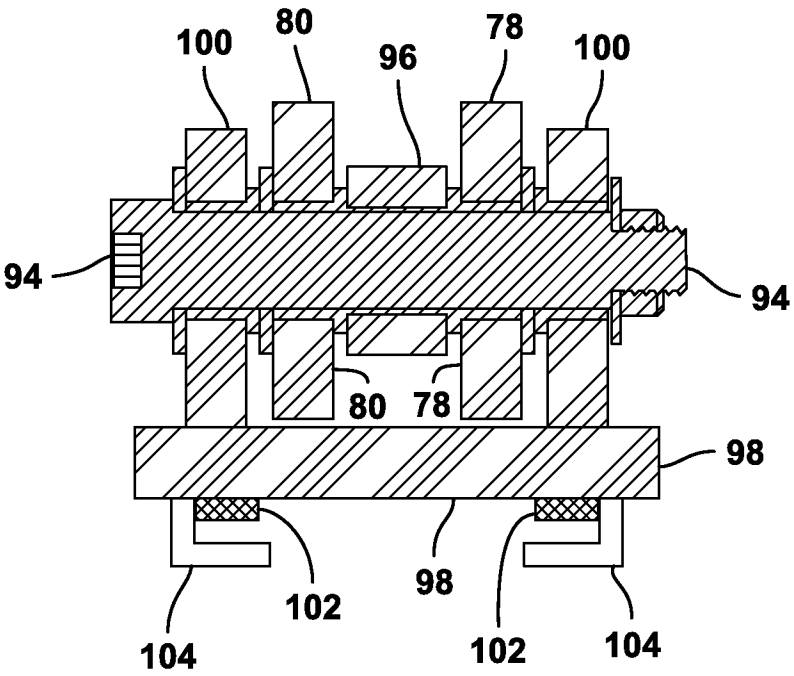
FIG. 24 is a sectional view taken along lines A-A of FIG. 23.
Figure 23:
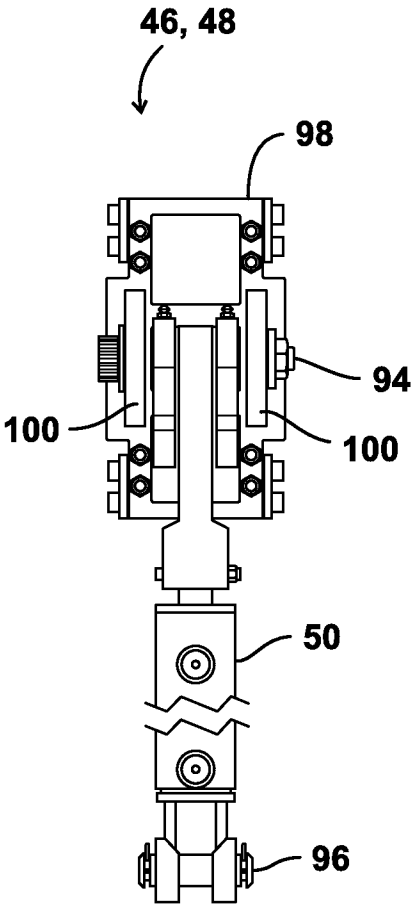
FIG. 23 is a fragmentary top view showing a preferred embodiment of a ratchet sleeve mechanism.
Figure 25:
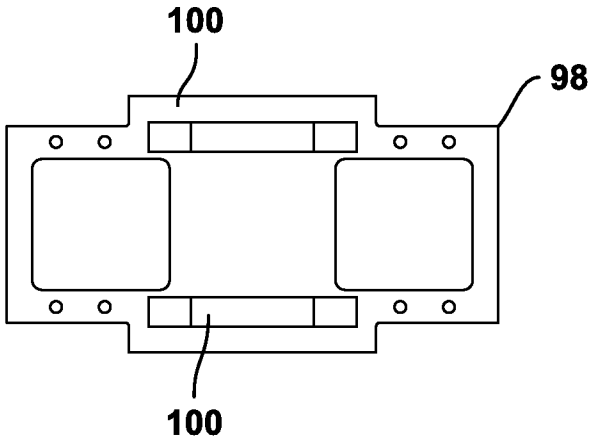
FIG. 25 is a fragmentary top view of a preferred embodiment of the apparatus of the present invention showing the ratchet sleeve mechanism base.
Figure 26:
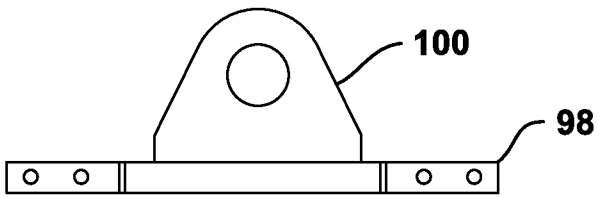
FIG. 26 is a fragmentary side view of a preferred embodiment of the apparatus of the present invention showing the ratchet sleeve mechanism base.
Figure 27:
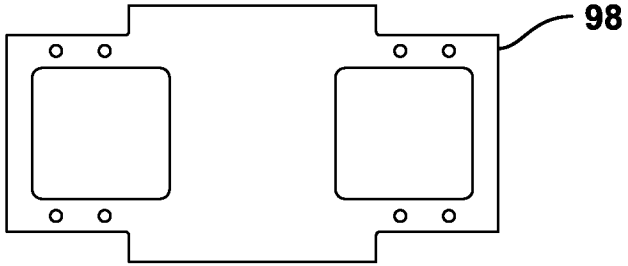
FIG. 27 is a fragmentary bottom view of a preferred embodiment of the apparatus of the present invention showing the ratchet sleeve mechanism base.
Figure 28:
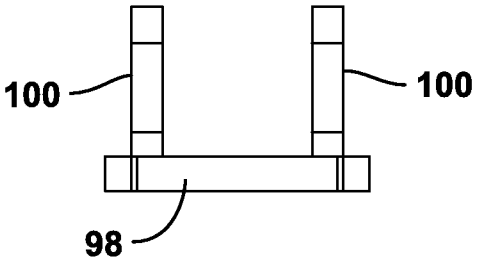
FIG. 28 is a fragmentary end view of a preferred embodiment of the apparatus of the present invention showing the ratchet sleeve mechanism base.
Figure 30:
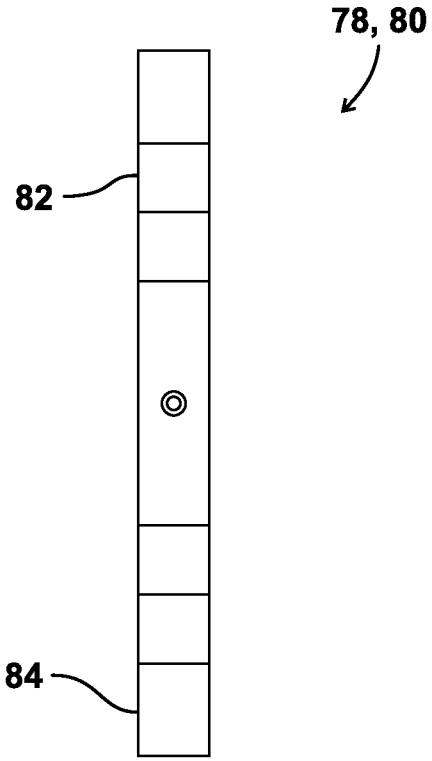
FIG. 30 is a fragmentary end view of a preferred embodiment of the apparatus of the present invention showing a cam or dog.
Figure 29:
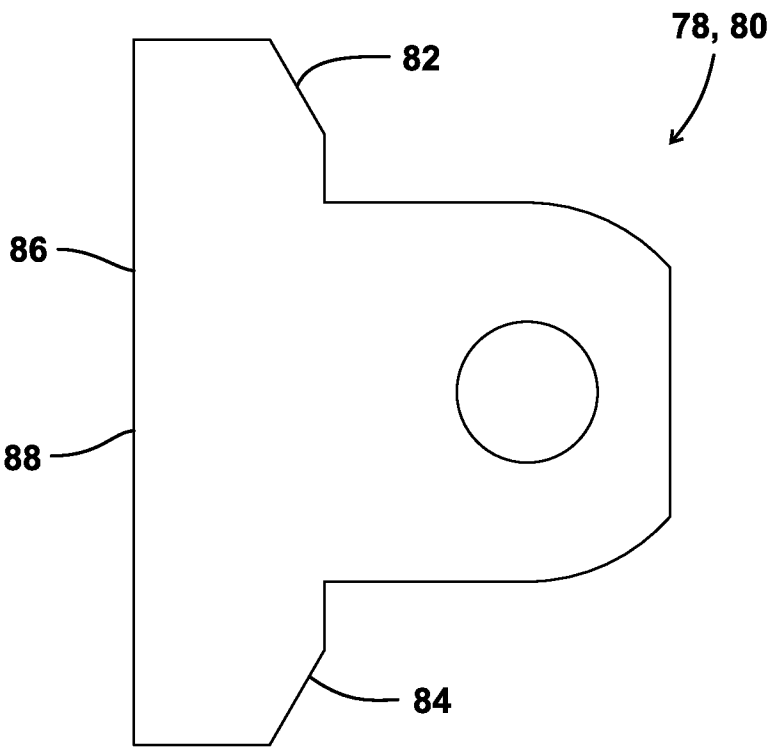
FIG. 29 is a fragmentary side view of a preferred embodiment of the apparatus of the present invention showing a cam or dog.
Figure 31:
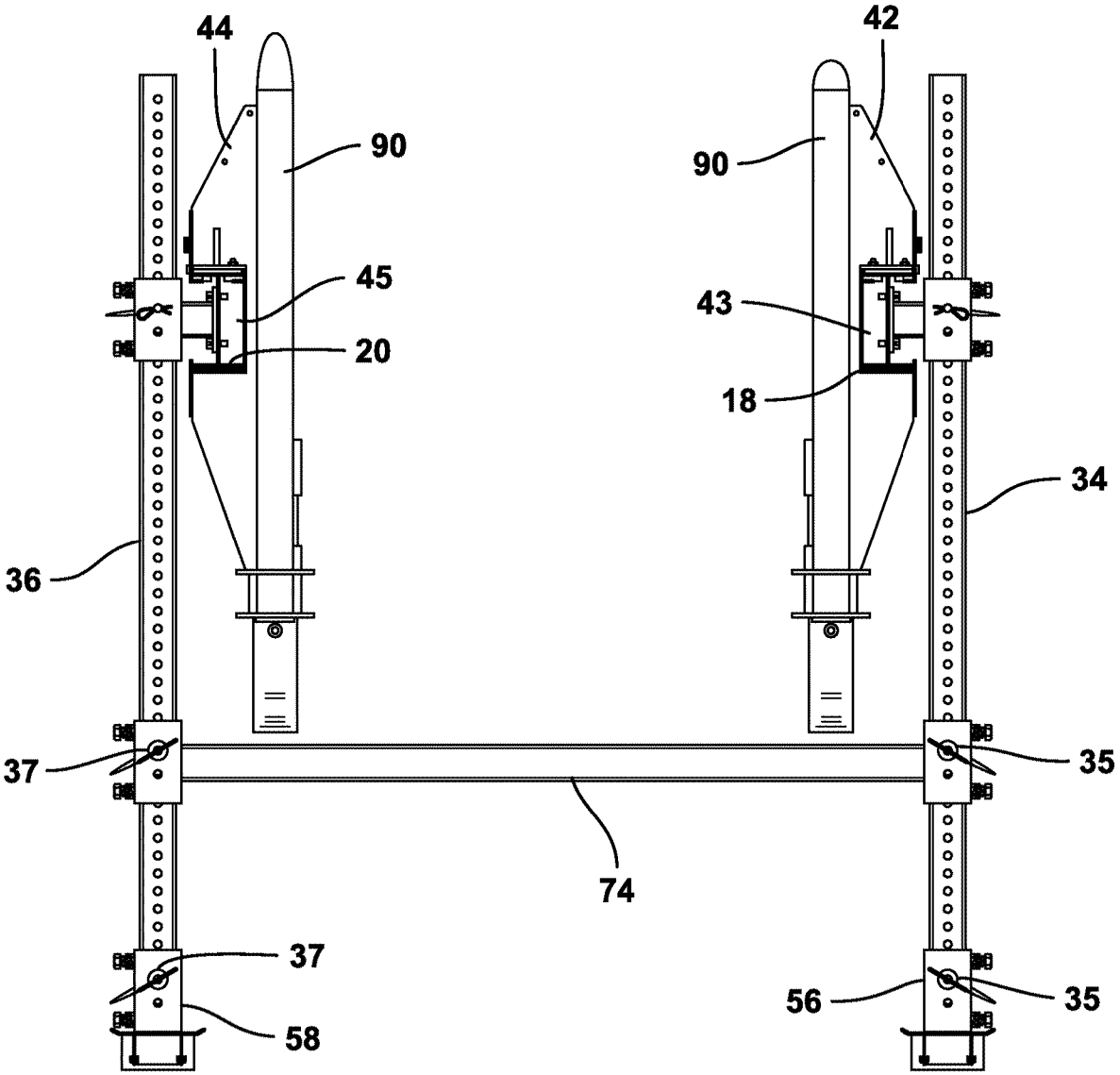
FIG. 31 is a partial end view of a preferred embodiment of the apparatus of the present invention.
Figure 32:
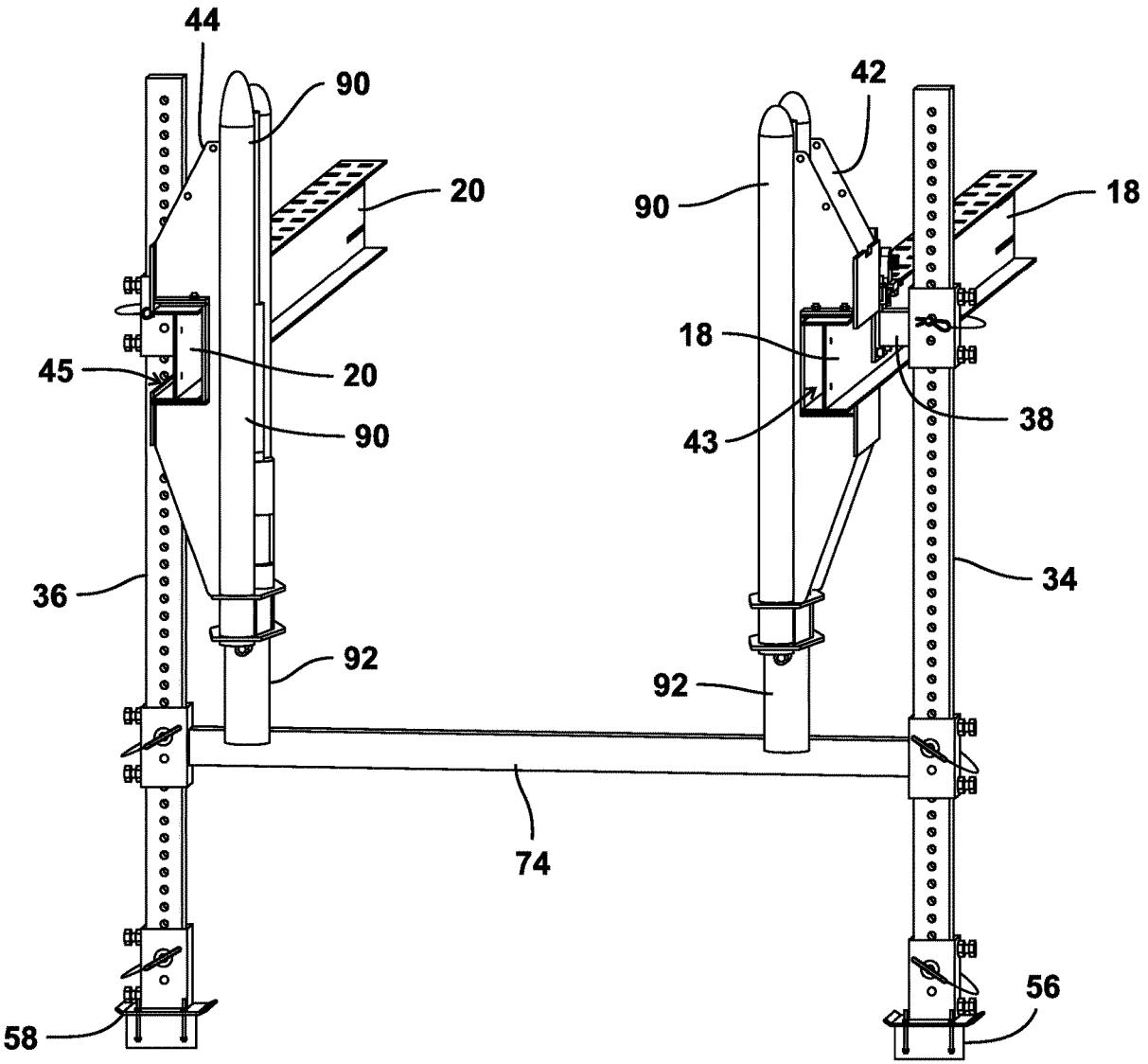
FIG. 32 is a partial perspective view of a preferred embodiment of the apparatus of the present invention.

FIGS. 2, 16-17 and 20 show the position of cams or dogs 78, 80 of ratchet sleeve mechanisms 46, 48 when pulling carriages 42, 44 and saddle 14 towards the BOP body 11. For removal of an upper bonnet 12A or lower bonnet 12B, the cams or dogs 78, 80 are preferably rotated about 180 degrees to the position shown in FIGS. 19 and 22. During removal of a bonnet 12, e.g., an upper 12A or lower 12B bonnet (see FIG. 19), laterally away from body 11, each cylinder 50 is expanded and then contracted. In FIG. 19, when cylinders 50 expand or extend, carriages 42, 44 are pushed to move away from ratchet sleeve mechanisms 46, 48. When cylinder 50 retracts, it pulls ratchet sleeve mechanisms 46, 48 toward carriages 42, 44. Ratchet sleeves/ratchet sleeve mechanisms 46, 48 move relative to beams 18, 20.

Each beam 18, 20 is preferably provided with beam slots/holes/openings 19, 21 to interact with cams or dogs 78, 80 of each ratchet sleeve mechanism 46, 48. Cylinder 50 is used to pull or push a cam or dog 78, 80 from one beam opening 19 or 21 to another beam opening 19 or 21 as the ratchet sleeve mechanisms 46, 48 travel selectively toward or away from BOP body 11. The ratchet sleeve mechanisms 46, 48 allow the travel cylinders 50 to exert force on the main beams 18, 20 via the hole or slot 19, 21 pattern in the top of the main beams 18, 20. By simply extending and retracting travel cylinders 50, ratchet sleeve mechanisms 46, 48 automatically move cams 78, 80 from a hole or slot 19, 21 to another hole or slot 19, 21 along main beams 18, 20. When a cam or dog 78, 80 drops (via gravity) into a slot or opening or hole 19, 21, cylinder 50 can then transfer load to the beam 18 or 20 via vertical or longitudinal surface 86, 88 of a cam or dog 78, 80.

Referring to FIGS. 16-30, each ratchet sleeve mechanism 46, 48 preferably has a base or frame 98 with two (2) padeyes 100. Padeyes 100 preferably support pin or bolt or pivot or pinned connection 94. Two (2) cams or dogs 78, 80 are mounted on pin or pivot 94. Cylinder 50 also attaches to pin or bolt or pivot 94 at cylinder attachment or cylinder mount 96. Cylinder attachment or mount 96 is preferably positioned in between cams or dogs 78, 80. Cam or dog 78 is preferably positioned in between padeye 100 and cylinder attachment 96. Similarly, cam or dog 80 is positioned in between a padeye 100 and cylinder attachment 96 (see FIGS. 16-30). Base or frame 98 can be provided with glide pads 102 and keepers/ratchet sleeve keepers 104.

The cams or dogs 78, 80 are preferably reversible (by rotating a selected cam dog 78 or 80 upon pivot 94) depending upon the desired direction of travel (e.g., toward or away from the BOP body 11). Each dog or cam 78, 80 preferably has two (2) beveled surfaces 82, 84 that enable travel up and out of a beam slot 19, 21 (see FIGS. 29-30). Each cam or dog 78, 80 has a vertical or longitudinal surface 86, 88 that preferably transfers load from cylinder 50 to beams 18, 20 when the dogs or cams 78, 80 occupy a slot 19, 21 in a beam 18 or 20. When pulling the carriages 42, 44 toward BOP body 11, the dogs or cams 78, 80 occupy a slot 19 or 20. Cylinder 50 pulls against the dog or cam 78 or 80 surface 86, 88 to effect load transfer to the beams 18, 20 and thus travel of saddle 14 toward the BOP body 11. For removing upper bonnet 12A or lower bonnet 12B from BOP body 11, the position of each cam or dog 78, 80 for each ratchet sleeve mechanism 46, 48 is preferably rotated about 180 degrees about pivot or pinned connection 94 (See FIGS. 17-22). The hydraulic cylinder/travel cylinder 50 then pushes the carriages 42, 44 and upper bonnet 12A or lower bonnet 12B away from BOP body 11.

FIG. 3 illustrates the position of upper bonnet 12A after it has been moved upon beams 18, 20, a distance away from body 11. In this position, upper bonnet 12A has been moved a sufficient distance to clear any external supporting frame portions of the blowout preventer. After the lateral movement that is shown in FIG. 3, upper bonnet 12A can be lifted using a crane or other heavy lifting device that connects to padeyes or lifting fittings 76 of saddle assembly 17 for repair or service at a suitable repair facility. In one embodiment, upper bonnet 12A is transported between about 50 and 150 inches (127 and 381 cm), preferably about 100 inches (254 cm), when moving from the base or home position of FIG. 1 to the laterally spaced away position of FIG. 3.

FIGS. 1-5 show the legs 34, 36 of apparatus 10 of the present invention in more detail. In FIGS. 1-5, the legs 34, 36 can be seen as adjustable legs, each having a lower end portion 52, 54 fitted with a foot 56, 58. Locking pins 35, 37 can be used in combination with spaced apart openings 59, 60 to provide a vertical or longitudinal adjustment of about 2-3 feet (61-91 cm) for each of the legs 34, 36 (e.g., about 26 inches (66 cm) of vertical or longitudinal adjustment). The top bonnet bolts 13 that bolt upper bonnet 12A to body 11 can be accessible even though the saddle 14 is in place and bolted to the bonnet 12. By adjusting the vertical position of saddle 14, saddle 14 can be moved between upper bonnet 12A and lower bonnet 12B. The saddle 14 can be adjusted vertically using lift cylinders 92 on carriages 42, 44 (see FIGS. 12-15).

During assembly, the cylinders 50 on beams 18, 20 are preferably synced to align the carriages 42, 44 at equal distances from BOP body 11.

FIGS. 1-5 illustrates the attachment of a leg stabilizer 74 to legs 34, 36. The leg stabilizer 74 is preferably placed around legs 34, 36 and pinned into place at a location that will not interfere with movement of the upper, lower bonnets 12A, 12B upon beams 18, 20. Leg stabilizer 74 can be raised to a location that is close to the bottom of a bonnet 12, e.g., upper 12A or lower 12B bonnet, being removed without causing an obstruction to any moving equipment on bonnet handling tool 10. Leg stabilizer 74 can be pinned or bolted in place using a hitch pin 35, 37 or bolts/nuts, for example.

FIGS. 33-36 illustrate placement of brackets 28, 30 that support one end of each beam 18, 20 of the transport or railway. End brackets 28, 30 can be arranged on either side 26, 32 regardless of operation or complete tear down to remove either bonnet 12, e.g., upper 12A or lower 12B bonnet. In one embodiment, bonnet hinge 33 can be connected to flange 31 using bolts 39 in openings 97 of bonnet hinge 33. Bonnet hinge 33 can be used to connect flange 31 and upper bonnet 12A to body 11. Preferably, upper bonnet 12A and flange 31 can be removed from body 11 by removing bolts 13. When bonnet hinge 33 is connected to flange 31, upper bonnet 12A is preferably hingedly connected to body 11

Figure 33:
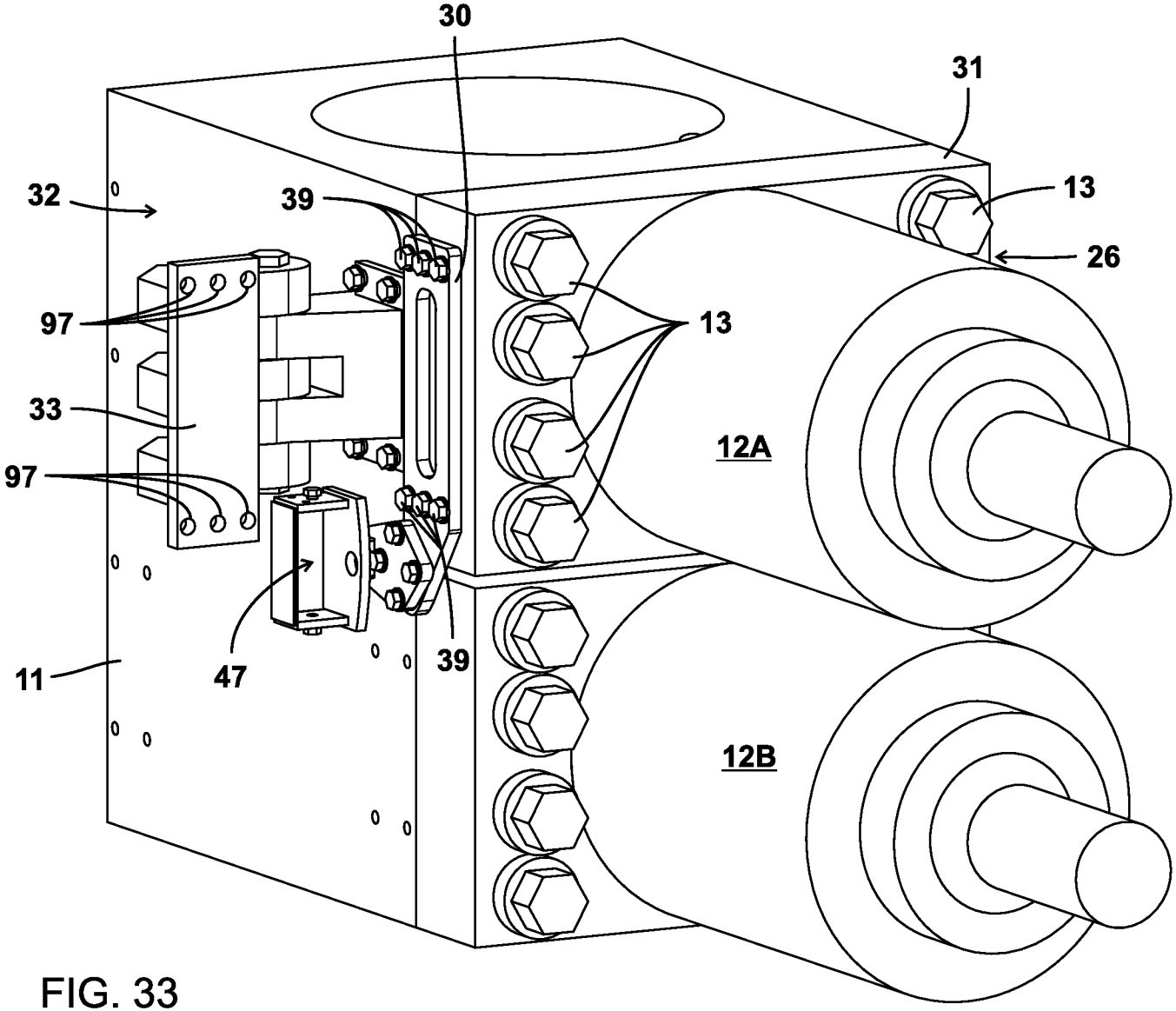
FIGS. 33-36 are partial perspective views of a preferred embodiment of the apparatus of the present invention.
Figure 34:
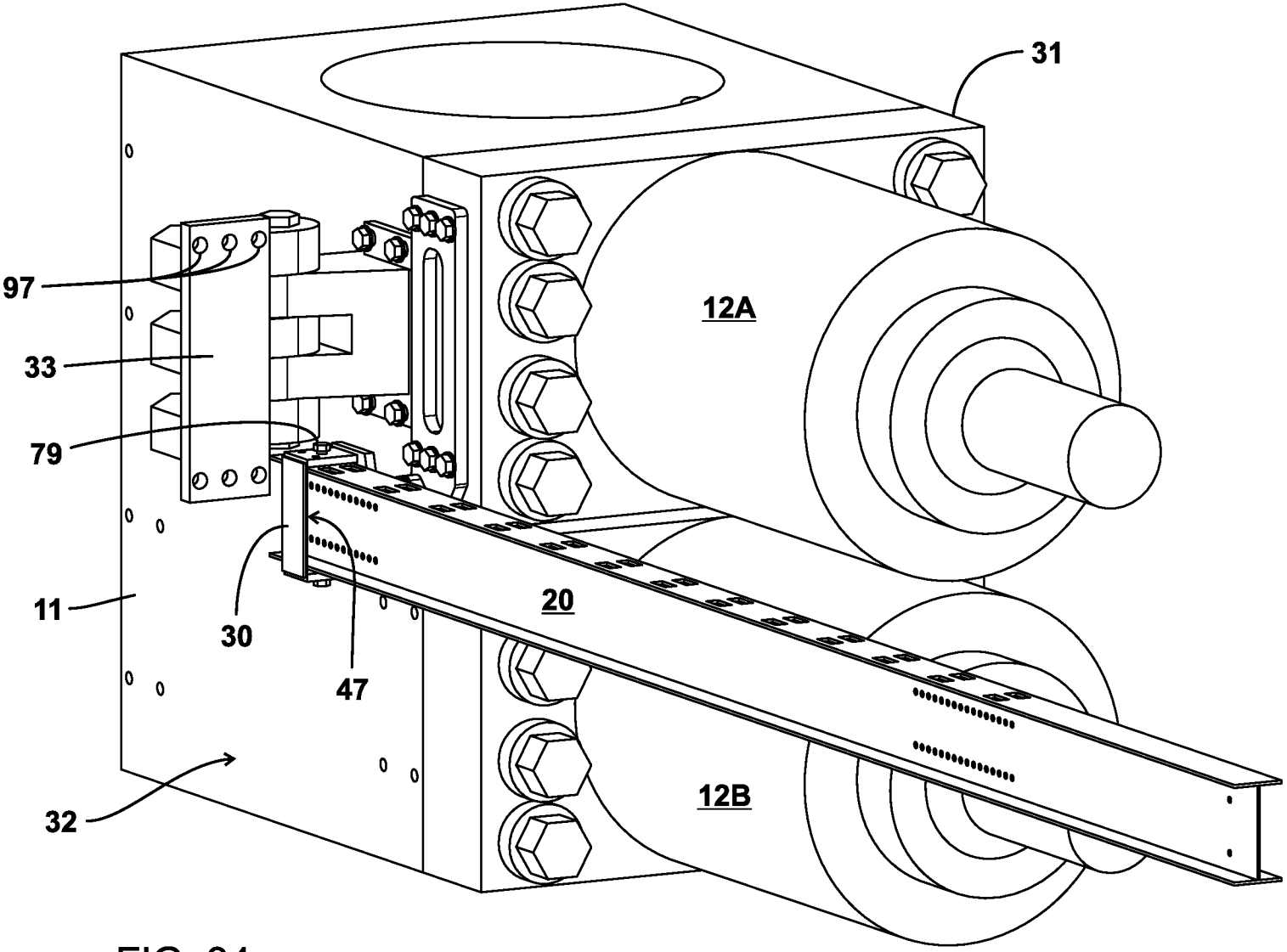

In FIG. 33, bonnet hinge 33 has been pivoted away from flange 31 by removing bolts (six bolts) 39. Bracket 30 is then bolted to flange 31 using the same bolts 39 as seen in FIG. 33. Bracket 30 has a rectangular socket 47 that is receptive of beam 20 (see FIG. 34).

Figure 35:
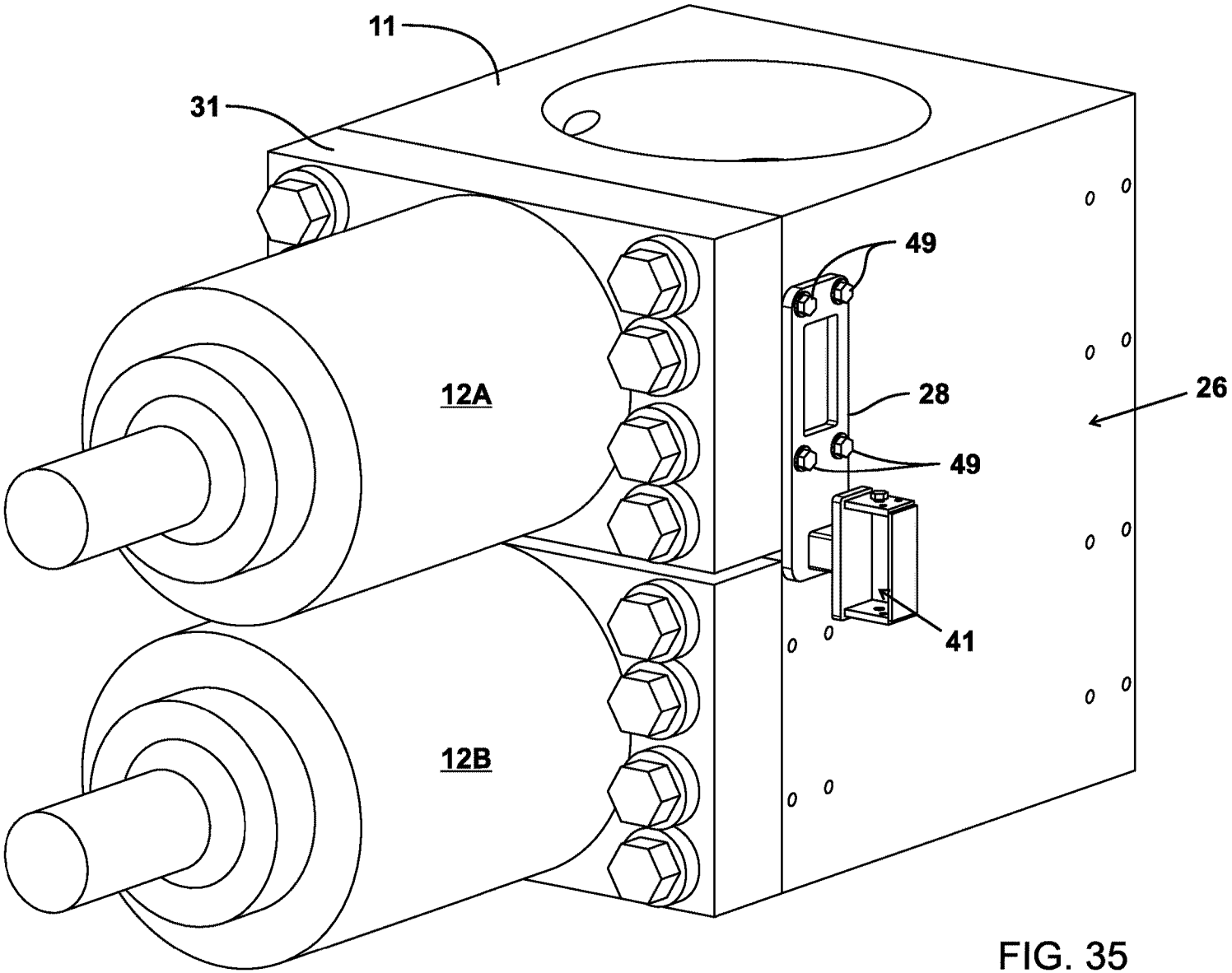
Figure 36:
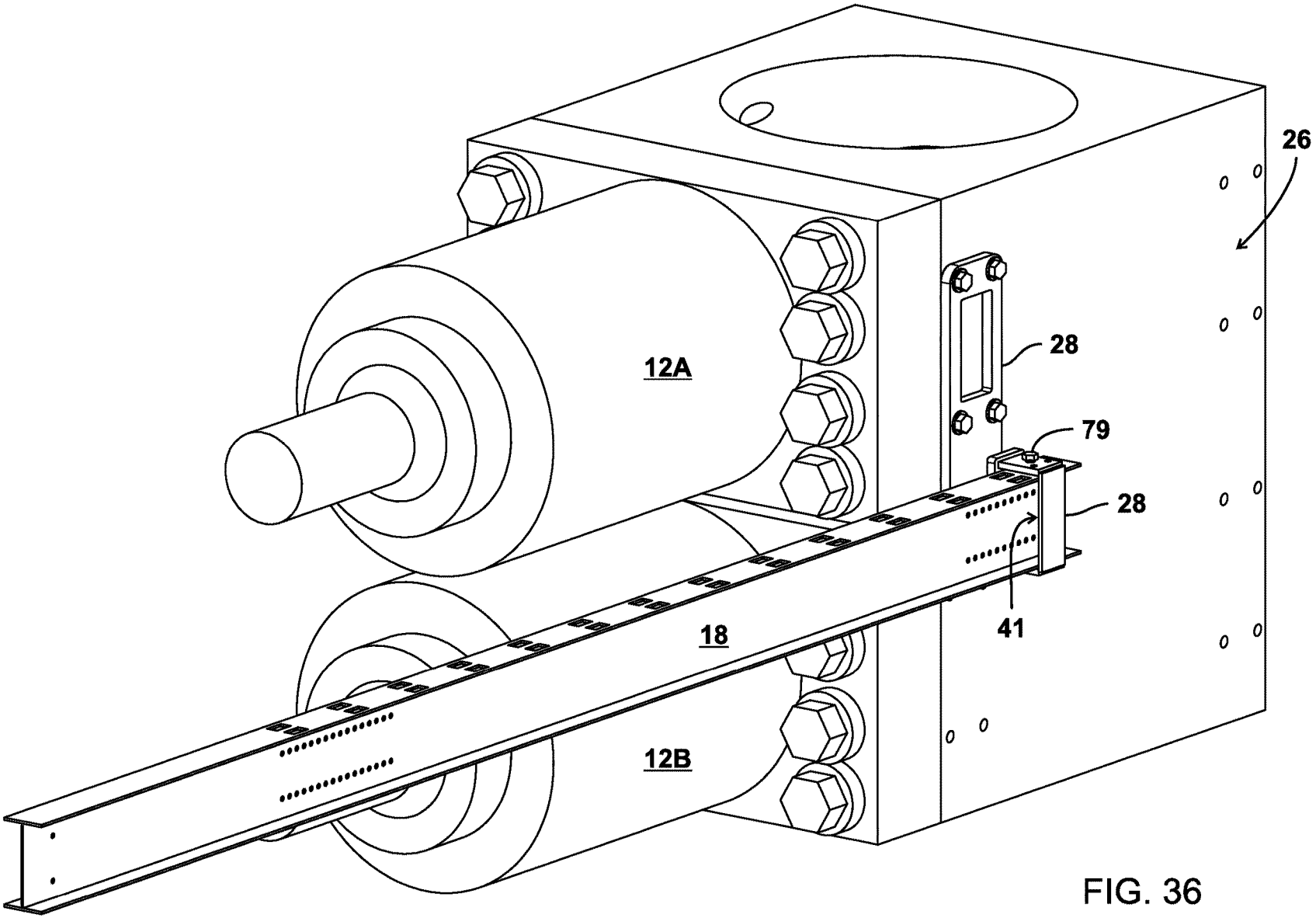
Figure 37:
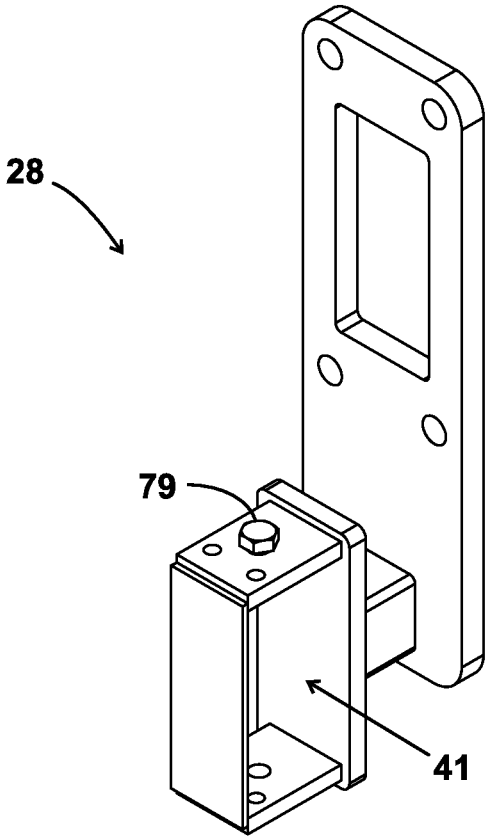
FIGS. 37-44 are views of the brackets of a preferred embodiment of the apparatus of the present invention.
Figure 40:
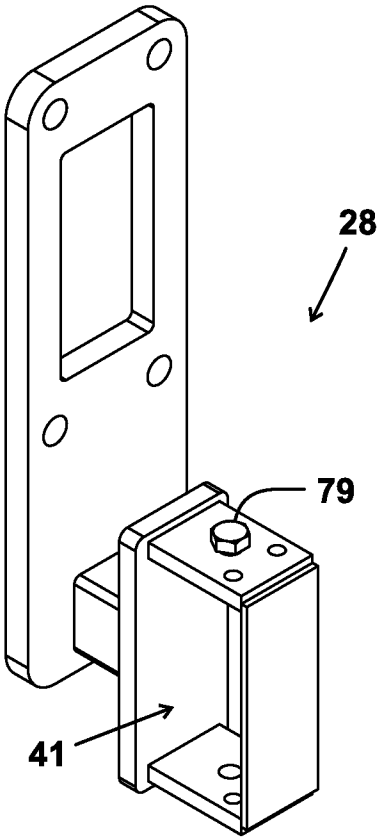
Figure 39:
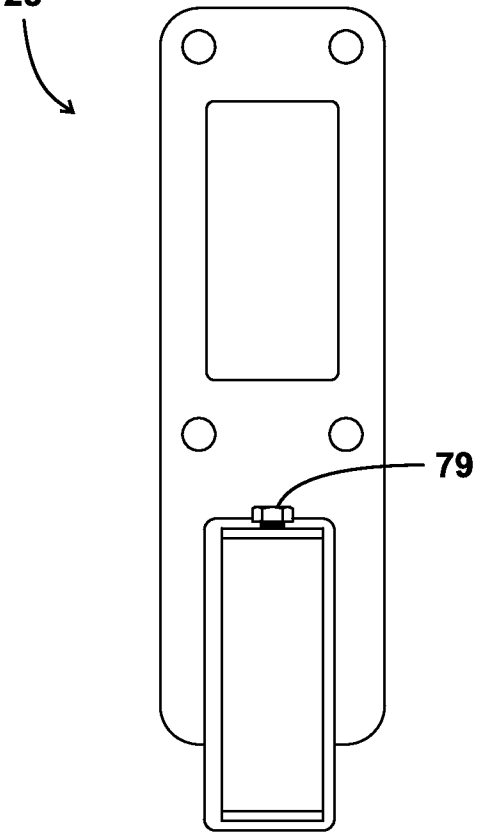
Figure 38:
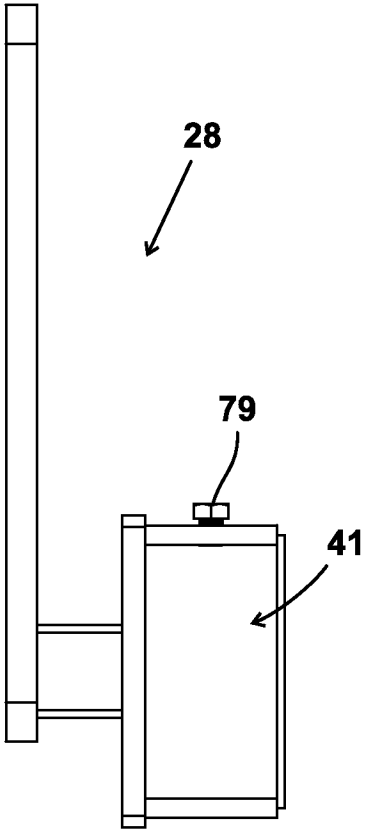
Figure 41:
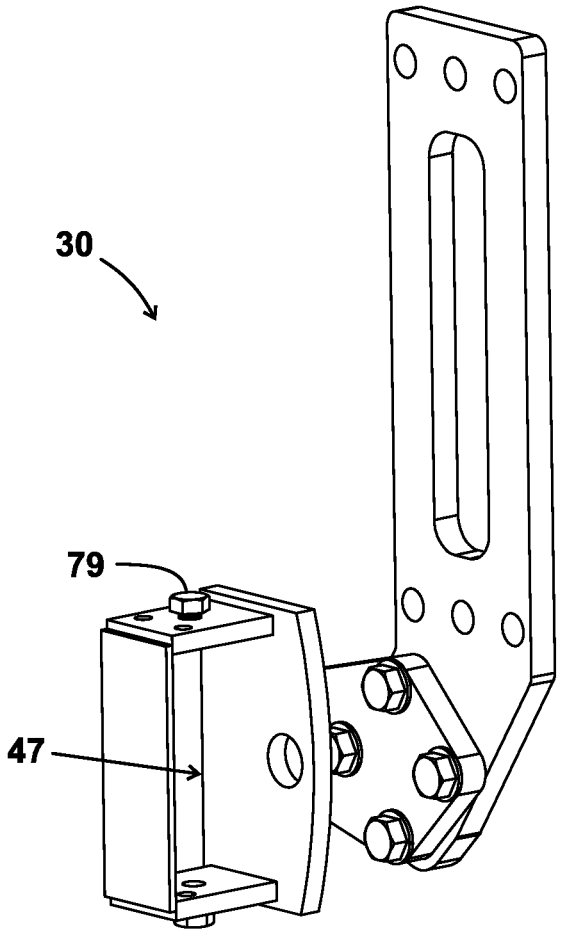
Figure 44:
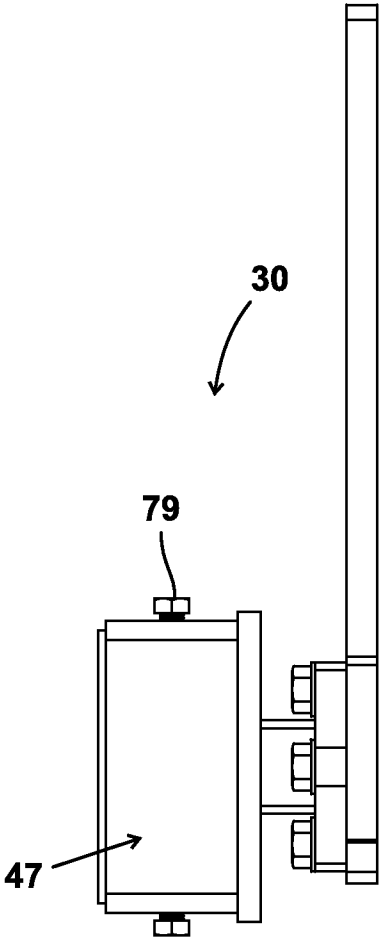
Figure 43:
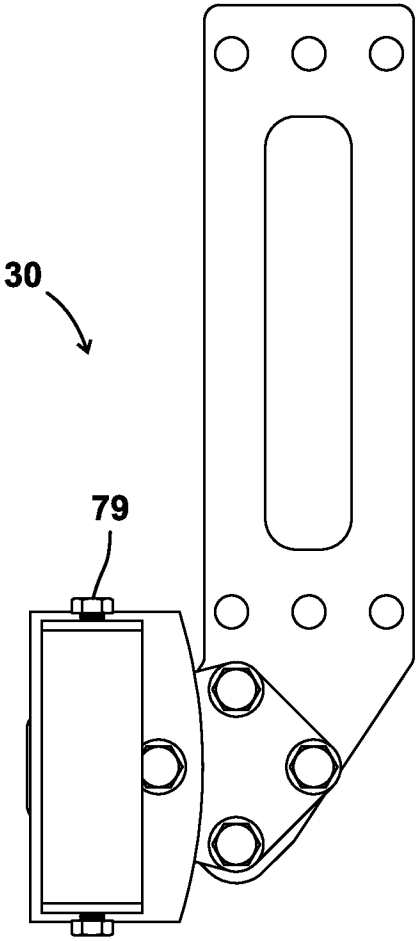
Figure 42:
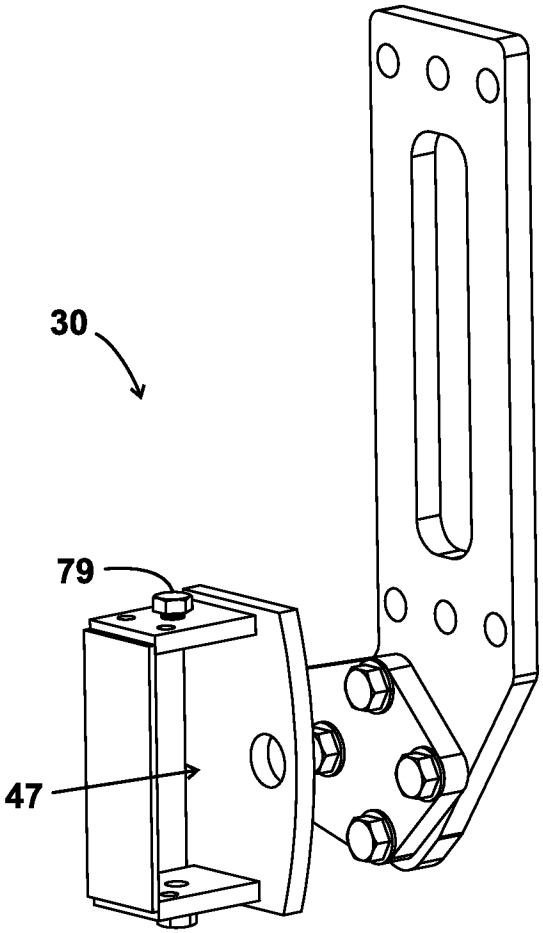

In FIG. 35, the bonnet hinge 33 has been completely removed and replaced with bracket 28 on side 26 of housing 11. Bracket 28 is bolted to body 11 using bolts 49 as seen in FIG. 35. Bracket 28 provides a rectangular socket 41 that is receptive of beam 18 as seen in FIG. 36. Each beam 18, 20 can be fastened to its bracket 28 or 30 using a fastener such as a bolt (or bolts) 79.

The following is a list of parts and materials suitable for use in the present invention:

PARTS LIST:

| PART NUMBER | DESCRIPTION |
|---|---|
| 10 | bonnet handling apparatus/tool, bonnet removal/handling tool |
| 11 | blowout preventer body/BOP body |
| 12 | bonnet |
| 12A | upper bonnet |
| 12B | lower bonnet |
| 13 | bolts |
| 14 | saddle |
| 15 | U-shaped member/concave member |
| 16 | strap/saddle strap |
| 17 | saddle assembly |
| 18 | first beam/rail/track/slotted beam |
| 19 | beam slot/hole/opening |
| 20 | second beam/rail/track/slotted beam |
| 21 | beam slot/hole/opening |
| 23 | free end |
| 25 | free end |
| 26 | side |
| 27 | hinge |
| 28 | bracket/mount/beam mount |
| 29 | turnbuckle |
| 30 | bracket/mount/beam mount |

-continued

PARTS LIST:

| PART NUMBER | DESCRIPTION |
|---|---|
| 31 | bonnet flange |
| 32 | side |
| 33 | bonnet hinge |
| 34 | leg/support leg |
| 35 | locking pin/hitch pin |
| 36 | leg/support leg |
| 37 | locking pin/hitch pin |
| 38 | horizontal section/lateral section |
| 39 | bolt |
| 40 | horizontal section/lateral section |
| 41 | rectangular socket |
| 42 | first carriage/carrier |
| 43 | carriage recess |
| 44 | second carriage/carrier |
| 45 | carriage recess |
| 46 | first ratchet sleeve mechanism/ratchet mechanism |
| 47 | rectangular socket |
| 48 | second ratchet sleeve mechanism/ratchet mechanism |
| 49 | bolt |
| 50 | expandable cylinder/hydraulic cylinder/travel cylinder/actuator |
| 51 | plate |
| 52 | lower end portion |
| 54 | lower end portion |
| 55 | vertical opening/longitudinal opening/sleeve/cylindrically shaped opening |
| 56 | foot |
| 58 | foot |
| 59 | opening |
| 60 | opening |
| 61 | plate |
| 67 | opening/pinned connection |
| 68 | web |
| 69 | opening |
| 70 | flange |
| 72 | flange |
| 74 | leg stabilizer/support leg brace |
| 76 | pad eyes/lifting fitting |
| 78 | cam/dog |
| 79 | bolt |
| 80 | cam/dog |
| 82 | beveled surface |
| 84 | beveled surface |
| 86 | vertical surface/longitudinal surface |
| 88 | vertical surface/longitudinal surface |
| 90 | bearing/guide |
| 91 | sleeve/bearing |
| 92 | lift cylinder/hydraulic cylinder/telescoping member |
| 93 | upper end |
| 94 | pivot/pin/bolt/pinned connection |
| 96 | attachment/mount/cylinder attachment |
| 97 | opening |
| 98 | base/frame |
| 99 | gusset/plate |
| 100 | padeyes |
| 102 | glide pad |
| 104 | ratchet sleeve keeper |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A blow out preventer bonnet removal method for removing a bonnet from a body of a blow out preventer, comprising the steps of:

a) attaching a rail system to the body that extends laterally away from the body;

b) mounting a carriage apparatus to the rail system;

c) connecting a saddle assembly to the bonnet;

d) detaching the bonnet from the body after step "c";

e) moving the bonnet from a first position next to the body to a second position spaced away from the body wherein the carriage apparatus transports the bonnet upon the rail system; and f) wherein step "e" includes ratcheting the carriage apparatus relative to the rail system.

2. The method of claim 1 wherein the rail system includes spaced apart rails and further comprising positioning the bonnet in between the rails.

3. The method of claim 1 wherein the saddle assembly is clamped to the bonnet in step "c".

4. The method of claim 1 wherein the ratcheting includes using hydraulic fluid to move the saddle assembly.

5. The method of claim 1 wherein in step "a" the rail system is supported by one or more legs.

6. The method of claim 1 further comprising the step of lifting the saddle assembly and bonnet after step "e" with an overhead lifting device.

7. The method of claim 6 wherein the saddle assembly has one or more pad-eyes and the lifting device attaches to the one or more pad-eyes.

8. The method of claim 1 wherein step "c" includes changing an elevation of the saddle assembly to fine tune alignment of the saddle assembly relative to the bonnet.

9. A blow out preventer bonnet removal method for removing a bonnet from a body of a blow out preventer, comprising the steps of:

a) attaching a pair of beams to the body that each extend laterally away from the body;

b) mounting carriages on the beams, the carriages supporting a saddle;

c) connecting the saddle to the bonnet;

d) detaching the bonnet from the body after step "c";

e) moving the bonnet from a first position next to the body to a second position that is spaced away from the body wherein the carriages transport the bonnet upon the beams; and f) wherein the beams interface with ratchet mechanisms on the carriages.

10. The method of claim 9 wherein the saddle is clamped to the bonnet in step "c".

11. A blow out preventer bonnet removal method for removing a bonnet from a body of a blow out preventer, comprising the steps of:

a) attaching a pair of beams to the body that each extend laterally away from the body;

b) mounting carriages on the beams, the carriages supporting a saddle;

c) connecting the saddle to the bonnet;

d) detaching the bonnet from the body after step "c";

e) moving the bonnet from a first position next to the body to a second position that is spaced away from the body wherein the carriages transport the bonnet upon the beams; and f) wherein step "e" includes ratcheting the carriages relative to the beams.

12. The method of claim 11 wherein the ratcheting includes using hydraulic fluid to move the carriages along the beams.

13. The method of claim 12 wherein in step "e" each beam has a ratchet system that includes one or more ratcheting sleeves mounted on each rail and a hydraulic cylinder that extends and retracts to move the bonnet a distance with each extension of said hydraulic cylinder.

14. The method of claim 11 further comprising the step of lifting the saddle and bonnet after step "e" with an overhead lifting device.

15. The method of claim 11 wherein step "c" includes changing an elevation of the saddle to fine tune alignment of the saddle relative to the bonnet.

16. The method of claim 11 wherein step "a" includes attaching a plurality of beam mounts to the body of the blow out preventer.

17. The method of claim 11 wherein in step "a" each of the pair of beams have a free end portion and further comprising supporting the pair of beams with one or more legs at a position in between the body of the blow out preventer and the free end portions.

* * * * *